US010662516B2

(12) United States Patent
Ooi et al.

(10) Patent No.: US 10,662,516 B2
(45) Date of Patent: May 26, 2020

(54) HOT-DIP AL—ZN—MG—SI COATED STEEL SHEET AND METHOD OF PRODUCING SAME

(71) Applicant: JFE STEEL CORPORATION, Chiyoda-ku, Tokyo (JP)

(72) Inventors: Toshihiko Ooi, Tokyo (JP); Yohei Sato, Tokyo (JP); Yoichi Tobiyama, Tokyo (JP); Toshiyuki Okuma, Tokyo (JP); Akihiko Furuta, Tokyo (JP); Masahiro Yoshida, Tokyo (JP); Yoshitsugu Suzuki, Tokyo (JP); Satoru Ando, Tokyo (JP); Akira Matsuzaki, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 150 days.

(21) Appl. No.: 15/553,658

(22) PCT Filed: Mar. 2, 2016

(86) PCT No.: PCT/JP2016/057255
§ 371 (c)(1),
(2) Date: Aug. 25, 2017

(87) PCT Pub. No.: WO2016/140370
PCT Pub. Date: Sep. 9, 2016

(65) Prior Publication Data

US 2018/0051366 A1 Feb. 22, 2018

(30) Foreign Application Priority Data

Mar. 2, 2015 (JP) ..... 2015-040643

(51) Int. Cl.
*C23C 2/06* (2006.01)
*C22C 18/04* (2006.01)
(Continued)

(52) U.S. Cl.
CPC ..... *C23C 2/06* (2013.01); *C22C 18/04* (2013.01); *C22C 21/10* (2013.01); *C22C 30/06* (2013.01); *C23C 2/12* (2013.01); *C23C 2/28* (2013.01)

(58) Field of Classification Search
None
See application file for complete search history.

(56) References Cited

U.S. PATENT DOCUMENTS 6,635,359 B1 10/2003 Kurosaki et al.
6,649,282 B1 11/2003 Yamaguchi et al.
(Continued)

FOREIGN PATENT DOCUMENTS

CN 101457320 A 6/2009
CN 102341523 A 2/2012
(Continued)

OTHER PUBLICATIONS

Sep. 22, 2017, Cancellation Reason Notice issued by the Japan Patent Office in the corresponding Japanese Patent No. 6059408, with partial English translation.
(Continued)

*Primary Examiner* — Adam Krupicka
(74) *Attorney, Agent, or Firm* — Kenja IP Law PC

(57) ABSTRACT

Provided is a hot-dip Al—Zn—Mg—Si coated steel sheet having good corrosion resistance in flat parts and edge parts, and also having excellent worked part corrosion resistance. The hot-dip Al—Zn—Mg—Si coated steel sheet includes a base steel sheet and a hot-dip coating on a surface of the base steel sheet. The hot-dip coating includes an interfacial alloy layer present at an interface with the base steel sheet and a main layer present on the interfacial alloy layer, and contains from 25 mass % to 80 mass % of Al, from greater than 0.6 mass % to 15 mass % of Si, and from greater than 0.1 mass
(Continued)

% to 25 mass % of Mg. The Mg content and Si content in the hot-dip coating satisfy formula (1):

$$M_{Mg}/(M_{Si}-0.6)>1.7 \quad (1)$$

where $M_{Mg}$ represents the Mg content (mass %) and $M_{Si}$ represents the Si content (mass %).

17 Claims, 6 Drawing Sheets

(51) Int. Cl.

| | |
|---|---|
| ***C23C 2/28*** | (2006.01) |
| ***C22C 30/06*** | (2006.01) |
| ***C23C 2/12*** | (2006.01) |
| ***C22C 21/10*** | (2006.01) |

(56) References Cited

U.S. PATENT DOCUMENTS

| | | | |
|---|---|---|---|
| 9,080,231 | B2 | 7/2015 | Fujii et al. |
| 9,428,824 | B2 | 8/2016 | Liu |
| 2011/0027613 | A1 | 2/2011 | Liu et al. |
| 2012/0088115 | A1 | 4/2012 | Smith et al. |
| 2012/0135261 | A1 | 5/2012 | Smith et al. |
| 2012/0282488 | A1 | 11/2012 | Fujii et al. |
| 2013/0004794 | A1 | 1/2013 | Liu et al. |

FOREIGN PATENT DOCUMENTS

| | | | |
|---|---|---|---|
| CN | 102449182 | A | 5/2012 |
| CN | 102762759 | A | 10/2012 |
| CN | 103764865 | A | 4/2014 |
| CN | 105483594 | A | 4/2016 |
| EP | 1225246 | A1 | 7/2002 |
| JP | S467161 | B | 2/1971 |
| JP | 2002012959 | A | 1/2002 |
| JP | 2011514935 | A | 5/2011 |
| JP | 5000039 | B2 | 8/2012 |
| JP | 5020228 | B2 | 9/2012 |
| JP | 2012520391 | A | 9/2012 |
| JP | 2013044024 | A | 3/2013 |
| TW | 201144481 | A1 | 12/2011 |
| WO | 0111100 | A1 | 2/2001 |
| WO | 2010135779 | A1 | 12/2010 |
| WO | 2011102434 | A1 | 8/2011 |
| WO | 2014019020 | A1 | 2/2014 |

OTHER PUBLICATIONS

Z. Chen et al., "A new quaternary phase observed in a laser treated Zn—Al—Mg—Si coating", Journal of Alloys and Compounds, 589 (2014), pp. 226-229.

Dec. 19, 2017, Extended European Search Report issued by the European Patent Office in the corresponding European Patent Application No. 16759061.1.

Jul. 31, 2018, Notification of Reasons for Refusal issued by the Japan Patent Office in the corresponding Japanese Patent Application No. 2016-188896 with English language concise statement of relevance.

Oct. 5, 2018, Office Action issued by the Korean Intellectual Property Office in the corresponding Korean Patent Application No. 10-2017-7027400 with English language concise statement of relevance.

Jul. 4, 2018, Office Action issued by the State Intellectual Property Office in the corresponding Chinese Patent Application No. 201680012543.2 with English language Search Report.

Jun. 22, 2018, Office Action issued by IP Australia in the corresponding Australian Patent Application No. 2016226812.

Apr. 5, 2016, International Search Report issued in the International Patent Application No. PCT/JP2016/057255.

Oct. 6, 2016, Office Action issued by the Taiwan Intellectual Property Office in the corresponding Taiwanese Patent Application No. 105106302 with English language Search Report.

HOT-DIP AL—ZN—MG—SI COATED STEEL SHEET AND METHOD OF PRODUCING SAME

TECHNICAL FIELD

This disclosure relates to a hot-dip Al—Zn—Mg—Si coated steel sheet having good corrosion resistance in flat parts and edge parts, and also having excellent corrosion resistance in worked parts, and to a method of producing the same.

BACKGROUND

Hot-dip Al—Zn alloy-coated steel sheets have both the sacrificial protection of Zn and the high corrosion resistance of Al, and thus rank highly in terms of corrosion resistance among hot-dip galvanized steel sheets. For example, PTL 1 (JP S46-7161 B) discloses a hot-dip Al—Zn alloy-coated steel sheet in which the hot-dip coating contains from 25 mass % to 75 mass % of Al. Due to their excellent corrosion resistance, hot-dip Al—Zn alloy-coated steel sheets have been the subject of increased demand in recent years, particularly in the field of building materials for roofs, walls, and the like that undergo long-term exposure to outdoor environments, and the field of civil engineering and construction for guardrails, wiring, piping, sound proof walls, and the like.

The hot-dip coating of a hot-dip Al—Zn alloy-coated steel sheet includes a main layer and an alloy layer present at an interface of the main layer with a base steel sheet. The main layer is mainly composed of regions where Zn is contained in a supersaturated state and Al is solidified by dendrite solidification (α-Al phase dendritic regions), and remaining interdendritic regions between the dendrites, and has a structure with the α-Al phase stacked in multiple layers in the thickness direction of the hot-dip coating. Due to such characteristic hot-dip coating structure, the corrosion path from the surface becomes complex, making it difficult for corrosion to reach the base steel sheet. Therefore, better corrosion resistance can be achieved with a hot-dip Al—Zn alloy-coated steel sheet than with a hot-dip galvanized steel sheet having the same hot-dip coating thickness.

The inclusion of Mg in a hot-dip Al—Zn alloy coating is a known technique for further improving corrosion resistance.

In one example of a technique relating to a hot-dip Al—Zn alloy-coated steel sheet containing Mg (hot-dip Al—Zn—Mg—Si coated steel sheet), PTL 2 (JP 5020228 B) discloses an Al—Zn—Mg—Si coated steel sheet in which the hot-dip coating contains a Mg-containing Al—Zn—Si alloy. The Al—Zn—Si alloy contains from 45 wt % to 60 wt % of aluminum, from 37 wt % to 46 wt % of zinc, and from 1.2 wt % to 2.3 wt % of silicon, and has a Mg concentration of from 1 wt % to 5 wt %.

Moreover, PTL 3 (JP 5000039 B) discloses a surface treated steel material having an Al alloy coating containing, by mass %, from 2% to 10% of Mg, from 0.01% to 10% of Ca, and from 3% to 15% of Si, the balance being Al and incidental impurities, and having a Mg/Si mass ratio in a specific range.

Hot-dip Al—Zn alloy-coated steel sheets that are to be used in the automotive field, and particularly those that are to be used for outer panels, are typically supplied to automobile manufacturers and the like in a state in which production up to hot-dip coating in a continuous galvanizing line (CGL) has been completed. After being worked into the shape of a panel component, the hot-dip Al—Zn alloy-coated steel sheet is typically subjected to chemical conversion treatment, and also general coating for automobile use by electrodeposition coating, intermediate coating and top coating. However, when a coating film of an outer panel obtained using a hot-dip Al—Zn alloy-coated steel sheet is scarred, the resulting scar acts as a start point for selective corrosion of interdendritic regions present at the interface of the coating film and the hot-dip coating that contain a large amount of Zn. As a result, there have been cases in which significantly greater coating film blistering has occurred than with a hot-dip Zn coating and in which it has not been possible to ensure adequate corrosion resistance (post-coating corrosion resistance). In response, PTL 4 (JP 2002-12959 A), for example, discloses a hot-dip Al—Zn alloy-coated steel sheet in which the formation of red rust from edge surfaces of the steel sheet is improved by adding Mg, Sn, or the like to the hot-dip coating composition in order that a Mg compound such as $Mg_2Si$, $MgZn_2$, $Mg_2Sn$, or the like is formed in the hot-dip coating layer.

CITATION LIST

Patent Literature

PTL 1: JP S46-7161 B
PTL 2: JP 5020228 B
PTL 3: JP 5000039 B
PTL 4: JP 2002-12959 A

SUMMARY

Technical Problem

As mentioned above, due to their excellent corrosion resistance, hot-dip Al—Zn alloy-coated steel sheets are often used in the field of building materials for roofs, walls, and the like that undergo long-term exposure to outdoor environments. Therefore, there is demand for the development of hot-dip Al—Zn—Mg—Si coated steel sheets with even better corrosion resistance in order to extend product life in response to recent requirements for resource conservation and energy efficiency.

Moreover, in the hot-dip Al—Zn—Mg—Si coated steel sheets disclosed in PTL 2 and 3, the hot-dip coating has a hard main layer and thus tends to crack when worked by bending. This is problematic as the cracking results in poorer corrosion resistance in worked parts (worked part corrosion resistance). Therefore, there is also demand for the improvement of worked part corrosion resistance. Also note that although reduced ductility due to Mg addition is remedied in PTL 2 through a "small" spangle size, in reality, it is essential that TiB is present in the hot-dip coating in PTL 2 in order to achieve this objective, and thus PTL 2 is not considered to disclose a fundamental solution.

Furthermore, even when the hot-dip Al—Zn alloy-coated steel sheet disclosed in PTL 4 is subjected to subsequent coating, the problem in relation to post-coating corrosion resistance is not resolved, and there are some applications for hot-dip Al—Zn alloy-coated steel sheets in which there is still demand for further improvement of post-coating corrosion resistance.

In view of the circumstances set forth above, it would be helpful to provide a hot-dip Al—Zn—Mg—Si coated steel sheet having good corrosion resistance in flat parts and edge parts, and also having excellent worked part corrosion resistance, and to provide a method of producing this hot-dip Al—Zn—Mg—Si coated steel sheet.

Solution to Problem

As a result of extensive studies conducted with the aim of solving the problems set forth above, we decided to focus on a finding that in corrosion of a hot-dip Al—Zn—Mg—Si coated steel sheet, $Mg_2Si$ present in interdendritic regions of a main layer of the hot-dip coating dissolves during initial corrosion, and Mg concentrates at the surface of corrosion products, which contributes to improvement of corrosion resistance, and also a finding that it is necessary to eliminate single phase Si since single phase Si present in the main layer acts as a cathode site, leading to dissolution of the surrounding hot-dip coating. We conducted further intensive research and discovered that worked part corrosion resistance can be significantly improved by prescribing the contents of Al, Mg, and Si components present in the main layer of the hot-dip coating and controlling the contents of Mg and Si in the hot-dip coating to within specific ranges such as to enable fine and uniform dispersion of $Mg_2Si$ in the interdendritic regions of the main layer. We also discovered that fine and uniform formation of $Mg_2Si$ can eliminate single phase Si from the main layer of the hot-dip coating, and thereby also improve corrosion resistance of flat parts and edge parts.

In addition to the above, we discovered that by controlling the Mg content in the hot-dip coating to within a specific range, excellent post-coating corrosion resistance can be obtained.

This disclosure is made based on these discoveries and primary features thereof are as described below.

(1) A hot-dip Al—Zn—Mg—Si coated steel sheet comprising a base steel sheet and a hot-dip coating on a surface of the base steel sheet, wherein the hot-dip coating includes an interfacial alloy layer present at an interface with the base steel sheet and a main layer present on the interfacial alloy layer, and contains from 25 mass % to 80 mass % of Al, from greater than 0.6 mass % to 15 mass % of Si, and from greater than 0.1 mass % to 25 mass % of Mg, and Mg content and Si content in the hot-dip coating satisfy formula (1):

$$M_{Mg}/(M_{Si}-0.6)>1.7 \quad (1)$$

where $M_{Mg}$ represents the Mg content in mass % and $M_{Si}$ represents the Si content in mass %.

(2) The hot-dip Al—Zn—Mg—Si coated steel sheet according to the foregoing (1), wherein the main layer contains $Mg_2Si$, and $Mg_2Si$ content in the main layer is 1.0 mass % or more.

(3) The hot-dip Al—Zn—Mg—Si coated steel sheet according to the foregoing (1), wherein the main layer contains $Mg_2Si$, and an area ratio of $Mg_2Si$ in a cross-section of the main layer is 1% or more.

(4) The hot-dip Al—Zn—Mg—Si coated steel sheet according to the foregoing (1), wherein the main layer contains $Mg_2Si$, and according to X-ray diffraction analysis, an intensity ratio of $Mg_2Si$ (111) planes having an interplanar spacing d of 0.367 nm relative to Al (200) planes having an interplanar spacing d of 0.202 nm is 0.01 or more.

(5) The hot-dip Al—Zn—Mg—Si coated steel sheet according to any one of the foregoing (1) to (4), wherein the interfacial alloy layer has a thickness of 1 μm or less.

(6) The hot-dip Al—Zn—Mg—Si coated steel sheet according to any one of the foregoing (1) to (4), wherein the main layer includes an α-Al phase dendritic region, and a mean dendrite diameter of the α-Al phase dendritic region and a thickness of the hot-dip coating satisfy formula (2):

$$t/d\geq 1.5 \quad (2)$$

where t represents the thickness of the hot-dip coating in μm and d represents the mean dendrite diameter in μm.

(7) The hot-dip Al—Zn—Mg—Si coated steel sheet according to any one of the foregoing (1) to (6), wherein the hot-dip coating contains from 25 mass % to 80 mass % of Al, from greater than 2.3 mass % to 5 mass % of Si, and from 3 mass % to 10 mass % of Mg.

(8) The hot-dip Al—Zn—Mg—Si coated steel sheet according to any one of the foregoing (1) to (6), wherein the hot-dip coating contains from 25 mass % to 80 mass % of Al, from greater than 0.6 mass % to 15 mass % of Si, and from greater than 5 mass % to 10 mass % of Mg.

(9) A method of producing a hot-dip Al—Zn—Mg—Si coated steel sheet, comprising hot-dip coating a base steel sheet by immersing the base steel sheet in a molten bath containing (consisting of) from 25 mass % to 80 mass % of Al, from greater than 0.6 mass % to 15 mass % of Si, and from greater than 0.1 mass % to 25 mass % of Mg, the balance being Zn and incidental impurities, subsequently cooling a resultant hot-dip coated steel sheet to a first cooling temperature at an average cooling rate of less than 10° C./sec, the first cooling temperature being no higher than a bath temperature of the molten bath and no lower than 50° C. below the bath temperature, and then cooling the hot-dip coated steel sheet from the first cooling temperature to 380° C. at an average cooling rate of 10° C./sec or more.

Advantageous Effect

According to this disclosure, it is possible to provide a hot-dip Al—Zn—Mg—Si coated steel sheet having good corrosion resistance in flat parts and edge parts, and also having excellent worked part corrosion resistance, and to provide a method of producing this hot-dip Al—Zn—Mg—Si coated steel sheet.

Figure 1A:
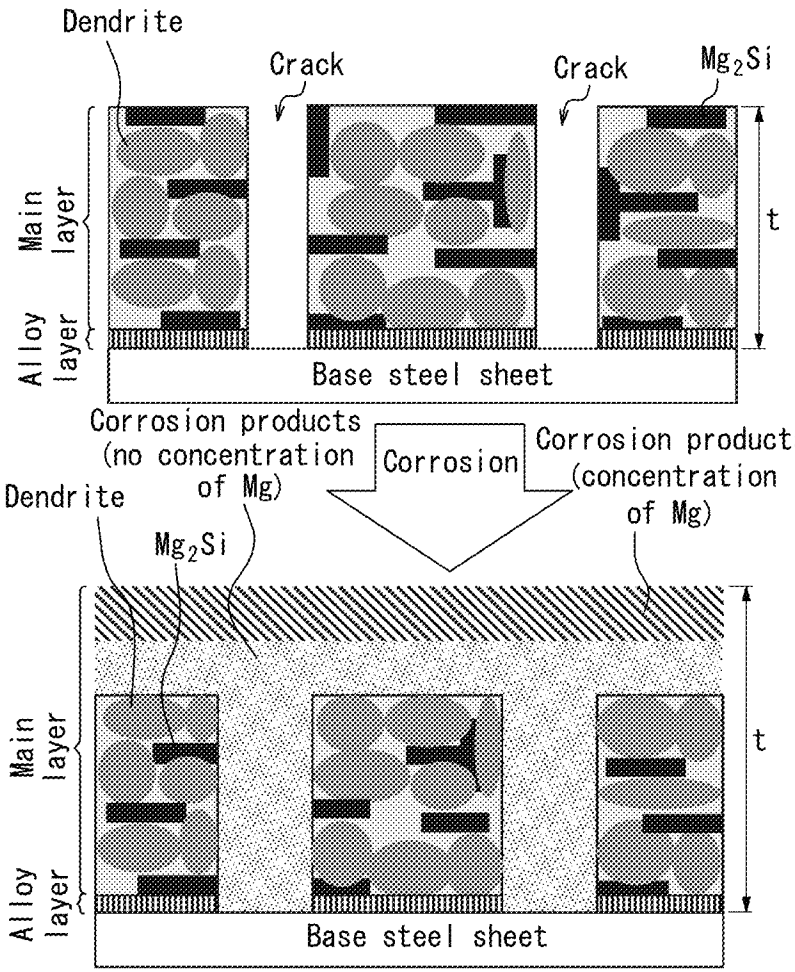
FIG. 1A illustrates pre- and post-corrosion states of a worked part of a disclosed hot-dip Al—Zn—Mg—Si coated steel sheet and FIG. 1B illustrates pre- and post-corrosion states of a worked part of a conventional hot-dip Al—Zn—Mg—Si coated steel sheet.

DETAILED DESCRIPTION (Hot-Dip Al—Zn—Mg—Si Coated Steel Sheet)

The hot-dip Al—Zn—Mg—Si coated steel sheet to which this disclosure relates includes a base steel sheet and a hot-dip coating on a surface of the base steel sheet. The hot-dip coating includes an interfacial alloy layer present at an interface with the base steel sheet, and a main layer present on the interfacial alloy layer. The hot-dip coating has a composition containing from 25 mass % to 80 mass % of Al, from greater than 0.6 mass % to 15 mass % of Si, and from greater than 0.1 mass % to 25 mass % of Mg, the balance being Zn and incidental impurities.

The Al content in the hot-dip coating is set as from 25 mass % to 80 mass %, and preferably from 35 mass % to 65 mass % from a viewpoint of balancing corrosion resistance with actual operation requirements. When the Al content of the main layer of the hot-dip coating is 25 mass % or more, dendrite solidification of Al occurs. This ensures a structure having excellent corrosion resistance in which the main layer is composed mainly of regions in which Zn is in a supersaturated state and Al is solidified by dendrite solidification (α-Al phase dendritic regions) and remaining interdendritic regions between the dendrites, and in which the dendritic regions are stacked in the thickness direction of the hot-dip coating. Corrosion resistance is improved as the number of stacked α-Al phase dendritic regions increases because the corrosion path becomes more complex, which makes it more difficult for corrosion to reach the base steel sheet. To obtain significantly high corrosion resistance, the Al content of the main layer is more preferably 35 mass % or more. On the other hand, if the Al content of the main layer is greater than 80 mass %, the content of Zn having sacrificial corrosion protection ability with respect to Fe decreases, and corrosion resistance deteriorates. Accordingly, the Al content of the main layer is set as 80 mass % or less. Furthermore, when the Al content of the main layer is 65 mass % or less, sacrificial corrosion protection ability with respect to Fe is ensured and adequate corrosion resistance is obtained even if the coating weight of the hot-dip coating is reduced and the steel base becomes more easily exposed. Accordingly, the Al content of the main layer of the hot-dip coating is preferably 65 mass % or less.

Si inhibits the growth of the interfacial alloy layer formed at the interface with the base steel sheet and is added to a molten bath for improving corrosion resistance and workability. Therefore, Si is inevitably contained in the main layer of the hot-dip coating. Specifically, when hot-dip coating treatment is performed in a molten bath containing Si in the case of an Al—Zn—Mg—Si coated steel sheet, an alloying reaction takes place between Fe in the surface of the base steel sheet and Al or Si in the bath upon immersion of the steel sheet in the molten bath, whereby an Fe—Al compound and/or an Fe—Al—Si compound is formed. The formation of this Fe—Al—Si interfacial alloy layer inhibits growth of the interfacial alloy layer. A Si content of greater than 0.6 mass % in the hot-dip coating enables adequate inhibition of interfacial alloy layer growth. On the other hand, if the Si content in the hot-dip coating is greater than 15 mass %, this may provide a propagation path for cracks in the hot-dip coating, which reduces workability and facilitates precipitation of a Si phase that then acts as a cathode site. Although precipitation of the Si phase can be inhibited by increasing the Mg content, this method leads to increased production cost and complicates management of the molten bath composition. Accordingly, the Si content in the hot-dip coating is set as 15 mass % or less. From a viewpoint of achieving a higher level of inhibition of both interfacial alloy layer growth and Si phase precipitation, the Si content in the hot-dip coating is preferably from greater than 2.3 mass % to 5 mass %, and particularly preferably from greater than 2.3 mass % to 3.5 mass %.

The hot-dip coating contains from greater than 0.1 mass % to 25 mass % of Mg. When the main layer of the hot-dip coating is corroded, Mg becomes included in the corrosion products, which improves the stability of the corrosion products and delays corrosion progression, resulting in an effect of improved corrosion resistance. More specifically, Mg in the main layer of the hot-dip coating bonds to the Si described above to form $Mg_2Si$. When the hot-dip coated steel sheet is corroded, this $Mg_2Si$ dissolves during initial corrosion, and thus Mg is included in the corrosion products. Mg concentrates at the surface of the corrosion products and has an effect of densifying the corrosion products such as to improve stability of the corrosion products and barrier properties against external causes of corrosion.

The reason for setting the Mg content of the hot-dip coating as greater than 0.1 mass % is that $Mg_2Si$ can be formed and a corrosion delaying effect can be obtained when the Mg content is greater than 0.1 mass %. On the other hand, the reason for setting the Mg content as 25 mass % or less is that, when the Mg content is greater than 25 mass %, in addition to the effect of corrosion resistance improvement reaching saturation, production cost increases and management of the molten bath composition becomes complicated. From a viewpoint of achieving a greater corrosion delaying effect while also reducing production cost, the Mg content in the hot-dip coating is preferably from 3 mass % to 10 mass %, and more preferably from 4 mass % to 6 mass %.

Moreover, a Mg content in the hot-dip coating of 5 mass % or more can improve post-coating corrosion resistance, which is one objective in the present disclosure. In the case of a conventional hot-dip Al—Zn alloy-coated steel sheet that does not contain Mg, a dense and stable oxide film of $Al_2O_3$ forms at the periphery of the α-Al phase straight after the hot-dip coating is exposed to the atmosphere. Through the protective action of this oxide film, solubility of the α-Al phase becomes significantly lower than that of a Zn-rich phase in the interdendritic regions. Consequently, upon scarring of the coating film of a coated steel sheet obtained using the conventional hot-dip Al—Zn alloy-coated steel sheet as a base, the scar acts as a start point for selective corrosion of the Zn-rich phase at an interface of the coating film and the hot-dip coating, and this corrosion progresses deep into a part where the coating film is not scarred, causing large coating film blisters. Therefore, post-coating corrosion resistance is poor. On the other hand, in the case of a coated steel sheet obtained using a hot-dip Al—Zn alloy-coated steel sheet that contains Mg as a base, a $Mg_2Si$ phase that precipitates in interdendritic regions or Mg—Zn compound ($MgZn_2$, $Mg_{32}(Al,Zn)_{49}$, etc.) dissolves from an initial stage of corrosion and Mg is taken into the corrosion products. Corrosion products including Mg are highly stable, which inhibits corrosion from the initial stage thereof. Moreover, this can inhibit large coating film blisters caused by selective corrosion of the Zn-rich phase, which is a problem in the case of a coated steel sheet obtained using the conventional hot-dip Al—Zn alloy-coated steel sheet as a base. Consequently, a hot-dip Al—Zn alloy-coated steel sheet having a Mg-containing hot-dip coating displays excellent post-coating corrosion resistance. When the Mg content is 5 mass % or less, post-coating corrosion resistance may not be improved because the amount of Mg that dissolves during corrosion is small and thus stable corrosion products such as described above are not sufficiently formed. Conversely, when the Mg content is greater than 10 mass %, not only does the effect thereof reach saturation, but strong Mg compound corrosion occurs and solubility of the hot-dip coating layer as a whole is excessively increased. As a result, a large blister width may arise and deterioration of post-coating corrosion resistance may occur even if the corrosion products are stabilized because the dissolution rate of the hot-dip coating layer is increased. Accordingly, the Mg content is preferably in a range of from greater than 5 mass % to 10 mass % so as to ensure excellent post-coating corrosion resistance.

In the disclosed hot-dip Al—Zn—Mg—Si coated steel sheet, from a viewpoint of effectively dispersing $Mg_2Si$ in the interdendritic regions, reducing the likelihood of formation of single phase Si, and achieving even better worked part corrosion resistance, it is preferable that the Mg content and the Si content in the hot-dip coating satisfy the following formula (1):

$$M_{Mg}/(M_{Si}-0.6)>1.7 \quad (1)$$

where $M_{Mg}$ represents the Mg content (mass %) and $M_{Si}$ represents the Si content (mass %).

Fine and uniform dispersion of $Mg_2Si$ can dramatically improve worked part corrosion resistance because $Mg_2Si$ gradually dissolves with Zn over the surface of the hot-dip coating and the entirety of the fracture surface of cracks in a worked part, a large amount of Mg is taken into the corrosion products, and a thick Mg-rich section is formed over the whole surface of the corrosion products, thereby inhibiting progression of corrosion. Moreover, fine and uniform dispersion of $Mg_2Si$ throughout the main layer of the hot-dip coating without uneven distribution can also improve corrosion resistance of flat parts and edge parts by eliminating single phase Si that acts as a cathode site from the main layer.

In contrast, according to conventional techniques, as described for example in PTL 3, $Mg_2Si$ is present as lumps of at least a certain size (specifically, lumps having a major diameter of 10 μm or more and a ratio of minor diameter to major diameter of 0.4 or more). Therefore, the $Mg_2Si$ is coarse and unevenly distributed, and thus has a much higher dissolution rate than Zn during initial corrosion, leading to preferential dissolution and elution of $Mg_2Si$. Consequently, Mg is not effectively taken into the corrosion products, small and localized Mg-rich sections form at the surface of the corrosion products, and the desired effect of corrosion resistance improvement is not obtained.

Figure 5:
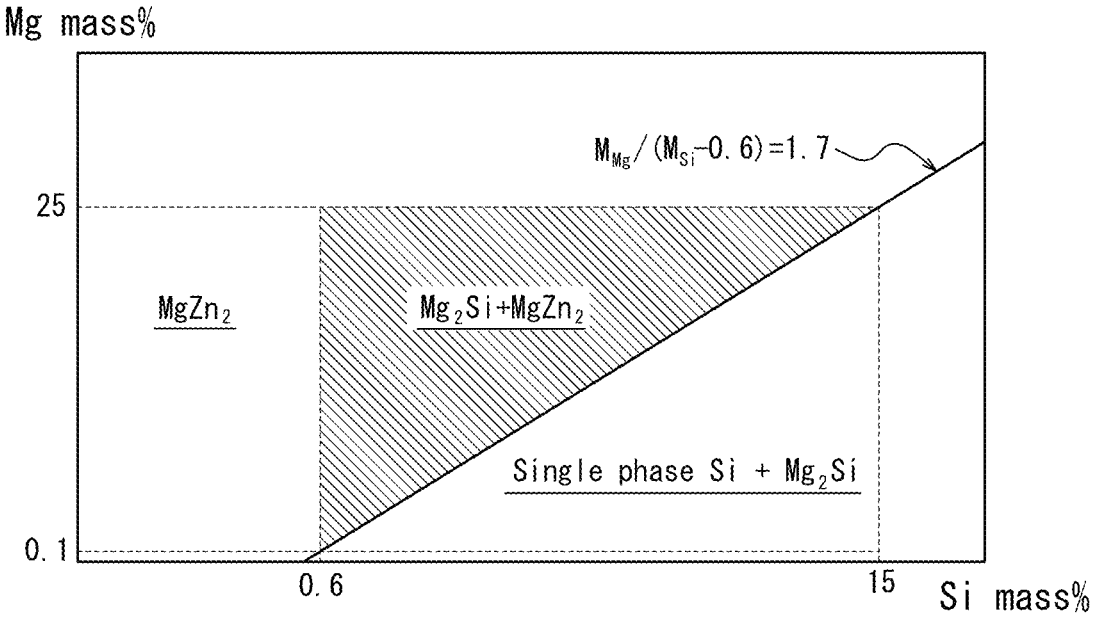
FIG. 5 illustrates a relationship between Si content and Mg content in a hot-dip coating and the state of phases formed in a main layer of the hot-dip coating.

FIG. 5 illustrates a relationship between Si content and Mg content in the hot-dip coating and the state of phases formed in the main layer of the hot-dip coating. It can be seen from FIG. 5 that within the scope of the disclosed composition (area surrounded by a dashed line in FIG. 5), single phase Si can be reliably eliminated from the main layer when formula (1) is satisfied.

The main layer of the hot-dip coating includes α-Al phase dendritic regions. The mean dendrite diameter of these dendritic regions and the thickness of the hot-dip coating satisfy the following formula (2):

$$t/d \geq 1.5 \quad (2)$$

where t represents the thickness of the hot-dip coating (μm) and d represents the mean dendrite diameter (μm).

When formula (2) is satisfied, the arms of the dendritic regions composed by the α-Al phase can be kept relatively small (i.e., the mean dendrite diameter can be kept relatively small), $Mg_2Si$ can be effectively dispersed in the interdendritic regions, and a state can be obtained in which $Mg_2Si$ is finely and uniformly dispersed throughout the main layer of the hot-dip coating without uneven distribution.

Figure 1B:
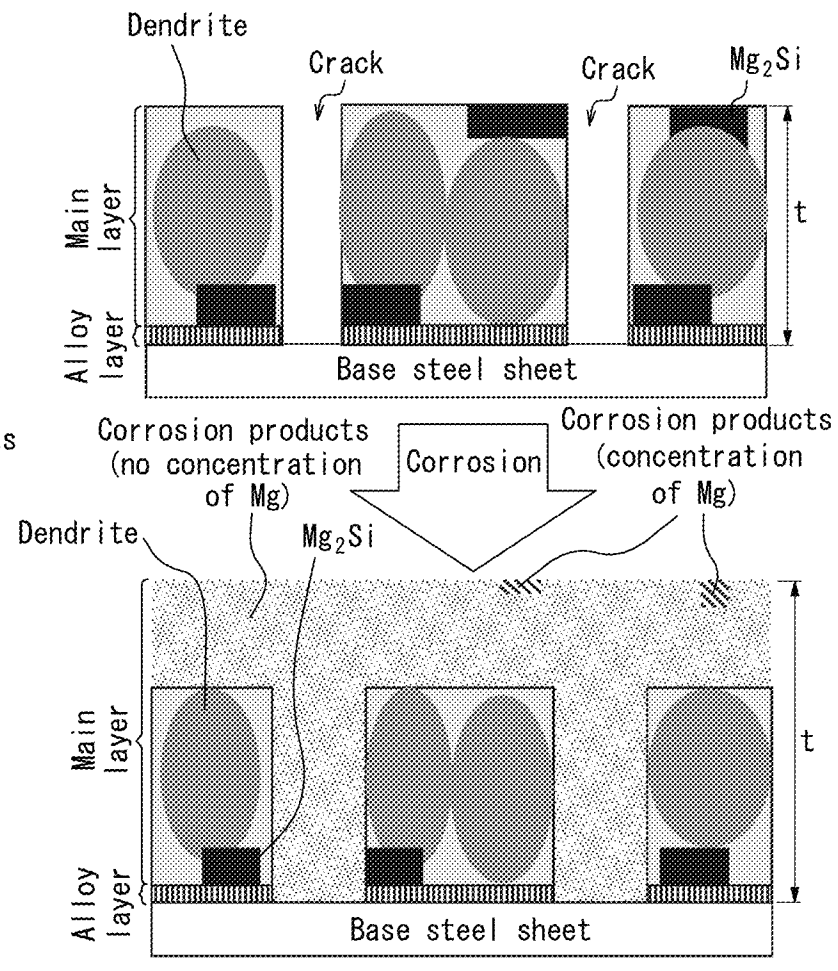

FIGS. 1A and 1B schematically illustrate the change in state of a main layer of a hot-dip coating during corrosion of a worked part in the case of the disclosed hot-dip Al—Zn—Mg—Si coated steel sheet and in the case of a hot-dip Al—Zn—Mg—Si coated steel sheet according to a conventional technique.

As illustrated in FIG. 1A, in the case of the disclosed hot-dip Al—Zn—Mg—Si coated steel sheet, the dendrites are small relative to the thickness t of the hot-dip coating, which facilitates fine and uniform dispersion of $Mg_2Si$. When a worked part of the disclosed hot-dip Al—Zn—Mg—Si coated steel sheet is corroded (note that cracks are present in the worked part), $Mg_2Si$ that is present at fracture surfaces of the cracks into the worked part of the hot-dip coating dissolves, and Mg concentrates at the surface of the corrosion products.

On the other hand, in the case of the conventional hot-dip Al—Zn—Mg—Si coated steel sheet, as illustrated in FIG. 1B, the dendrites are large relative to the thickness t of the hot-dip coating, which makes fine and uniform dispersion of $Mg_2Si$ difficult. When a worked part of the conventional hot-dip Al—Zn—Mg—Si coated steel sheet is corroded, $Mg_2Si$ that is present at fracture surfaces of the cracks into the worked part dissolves, and Mg concentrates along some of the surface of the corrosion product. However, since the degree of dispersion of $Mg_2Si$ throughout the main layer of the hot-dip coating is poor compared to the disclosed hot-dip Al—Zn—Mg—Si coated steel sheet, the Mg-rich section covering the surface of the corrosion products is reduced. This is thought to facilitate the progression of corrosion in the worked part, resulting in inadequate corrosion resistance.

Figure 2:
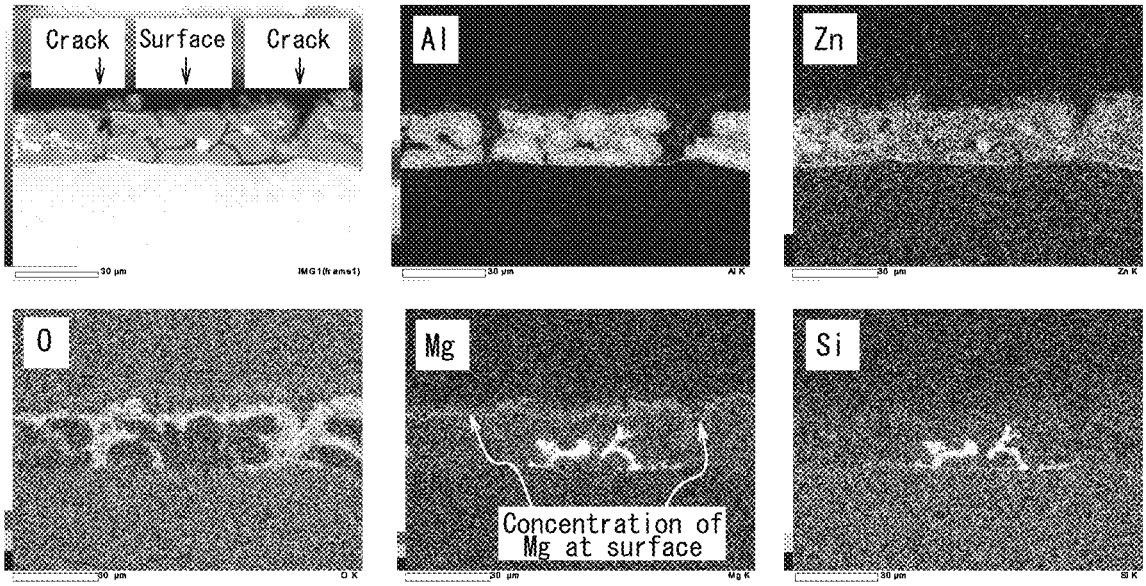
FIG. 2 illustrates, by scanning electron microscope energy dispersive X-ray spectroscopy (SEM-EDX), the states of various elements in a situation in which a worked part of a disclosed hot-dip Al—Zn—Mg—Si coated steel sheet is corroded.

FIG. 2 illustrates, by energy dispersive X-ray spectroscopy using a scanning electron microscope (SEM-EDS), the states of various elements when a worked part is corroded in the case of the disclosed hot-dip Al—Zn—Mg—Si coated steel sheet. It can be seen from FIG. 2 that when a worked part is corroded in the disclosed hot-dip Al—Zn—Mg—Si coated steel sheet, Mg concentrates at the surface of the main layer of the hot-dip coating (refer to the photograph for Mg in FIG. 2).

Figure 3:
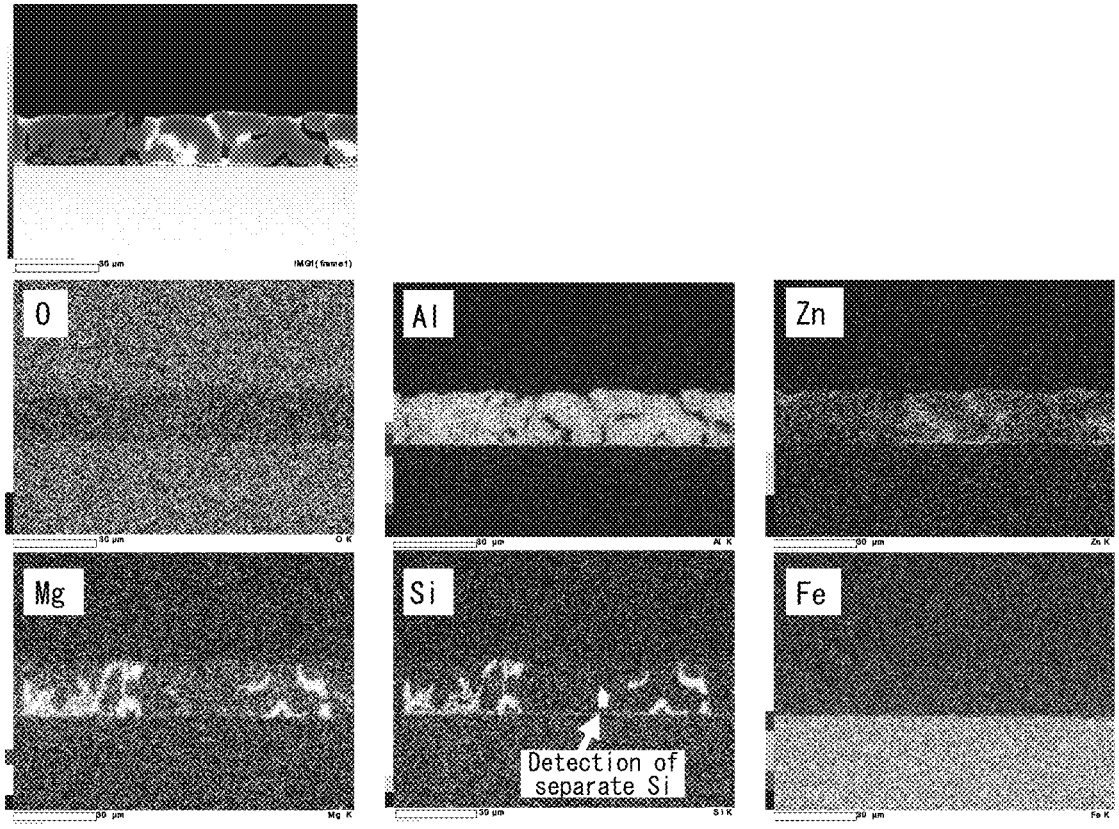
FIG. 3 illustrates, by SEM-EDX, the states of various elements in the case of a conventional hot-dip Al—Zn—Mg—Si coated steel sheet.

FIG. 3 illustrates, by SEM-EDS, the states of various elements in the case of a hot-dip Al—Zn—Mg—Si coated steel sheet in which the hot-dip coating has a composition within the scope of this disclosure (Al: 55 mass %, Si: 1.6 mass %, Mg: 2.5 mass %), but in which the mean dendrite diameter of dendritic regions in the main layer and the thickness of the hot-dip coating do not satisfy the above formula (2). Upon observation, a small amount of precipitation of a Si single phase can be confirmed, and thus reduced corrosion resistance is inferred (refer to the photograph for Si in FIG. 3).

The term "dendrite diameter" refers to the center distance between adjacent dendrite arms (dendrite arm spacing). Herein, the dendrite diameter is measured in accordance with the following method.

Figure 4:
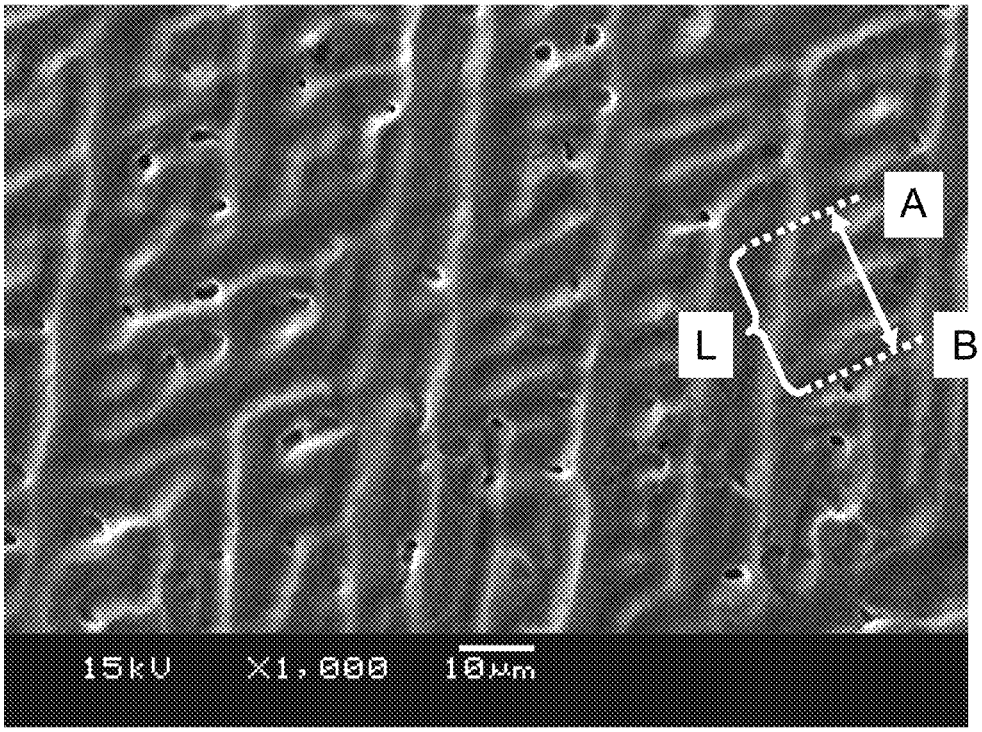
FIG. 4 illustrates a method of measuring dendrite diameter.

Specifically, as illustrated in FIG. 4, the surface of the main layer of the hot-dip coating is polished and/or etched and is observed under magnification (for example, observed under ×200 magnification) using a scanning electron microscope (SEM), and in a randomly selected field of view, a region where at least three dendrite arms are aligned is selected (three dendrites between A and B are selected in FIG. 4), and the distance along a direction of alignment of the arms (distance L in FIG. 4) is measured. Thereafter, the measured distance is divided by the number of dendrite arms (L/3 in FIG. 4) to calculate the dendrite diameter. The dendrite diameter is measured at three or more locations in one field of view, and the mean of the dendrite diameters obtained at these locations is calculated to determine the mean dendrite diameter.

In the disclosed hot-dip Al—Zn—Mg—Si coated steel sheet, the main layer contains $Mg_2Si$ as described above, and the $Mg_2Si$ content in the main layer is preferably 1.0 mass % or more. This enables fine and uniform dispersion of $Mg_2Si$ throughout the main layer of the hot-dip coating in a more reliable manner such that the desired corrosion resistance can be achieved.

Herein, the $Mg_2Si$ content is measured by, for example, dissolving the hot-dip coating of the Al—Zn—Mg—Si coated steel sheet in acid and then measuring the amounts ($g/m^2$) of Si and Mg by ICP analysis (high-frequency inductively coupled plasma emission spectroscopy). The content in the interfacial alloy layer (0.45 $g/m^2$ per 1 μm of interfacial alloy layer) is subtracted from the amount of Si, and the difference is multiplied by 2.7 to convert to the amount ($g/m^2$) of $Mg_2Si$, which is then divided by the hot-dip coating weight ($g/m^2$) to calculate the mass percentage of $Mg_2Si$. However, any analytical method by which the $Mg_2Si$ content can be determined may be used.

The area ratio of $Mg_2Si$ in the main layer upon observation of a cross-section of the main layer is preferably 1% or more. This enables fine and uniform dispersion of $Mg_2Si$ throughout the main layer of the hot-dip coating in a more reliable manner such that the desired corrosion resistance can be achieved.

Herein, the area ratio of $Mg_2Si$ is determined by, for example, performing SEM-EDX mapping of a cross-section of the hot-dip coating of the Al—Zn—Mg—Si coated steel sheet and then using image processing to calculate the area ratio (%) of regions where Mg and Si are detected overlapping with one another (i.e., regions where $Mg_2Si$ is present) in one field of view. However, any method that can determine the area ratio of regions where $Mg_2Si$ is present may be used.

Moreover, with regards to $Mg_2Si$ contained in the main layer, it is preferable that according to X-ray diffraction analysis, an intensity ratio of $Mg_2Si$ (111) planes (interplanar spacing d=0.367 nm) relative to Al (200) planes (interplanar spacing d=0.202 nm) is 0.01 or more. This enables fine and uniform dispersion of $Mg_2Si$ throughout the main layer of the hot-dip coating in a more reliable manner such that the desired corrosion resistance can be achieved.

Herein, this intensity ratio is calculated by obtaining an X-ray diffraction pattern under conditions of, for example, a tube voltage of 30 kV, a tube current of 10 mA, a Cu Kα tube (wavelength $\lambda$=0.154 nm), and a measurement angle 2θ of from 10° to 90°, measuring the intensity of (200) planes (interplanar spacing d=0.2024 nm) indicating Al and the intensity of (111) planes (interplanar spacing d=0.367 nm) indicating $Mg_2Si$, and then dividing the latter by the former. However, no specific limitations are placed on the X-ray diffraction analysis conditions.

With regards to $Mg_2Si$ particles that are finely and uniformly dispersed in the interdendritic regions, the ratio of the minor diameter thereof relative to the major diameter thereof is preferably 0.4 or less, and more preferably 0.3 or less.

In conventional techniques, the ratio of the minor diameter relative to the major diameter of $Mg_2Si$ particles is 0.4 or more as described, for example, in PTL 3. Since $Mg_2Si$ is coarse and has an uneven distribution in this situation, the dissolution rate of $Mg_2Si$ during initial corrosion is much higher than that of Zn, and $Mg_2Si$ preferentially dissolves and elutes, as a result of which, Mg is not effectively taken into the corrosion products, a smaller number of localized Mg-rich sections form at the surface of the corrosion products, and an effect of corrosion resistance improvement is not obtained.

On the other hand, setting a large difference between the major and minor diameters (aspect ratio) in the disclosed techniques contributes to fine and uniform dispersion of $Mg_2Si$ particles present at the surface of the hot-dip coating and at fracture surfaces of cracks into a worked part. This can dramatically improve worked part corrosion resistance because $Mg_2Si$ gradually dissolves with Zn during corrosion, a large amount of Mg is taken into the corrosion products, and a thick Mg-rich section is formed over the whole surface of the corrosion products, thereby inhibiting progression of corrosion.

Herein, the "major diameter" of $Mg_2Si$ refers to the longest diameter in a $Mg_2Si$ particle and the "minor diameter" of $Mg_2Si$ refers to a shortest diameter in a $Mg_2Si$ particle.

From a viewpoint of obtaining better corrosion resistance, the hot-dip coating preferably further contains Ca. In a situation in which the hot-dip coating further contains Ca, the total Ca content is preferably from 0.2 mass % to 25 mass %. When the total content is within the range set forth above, an adequate corrosion delaying effect can be obtained without this effect reaching saturation.

Furthermore, the main layer preferably further contains one or more selected from Mn, V, Cr, Mo, Ti, Sr, Ni, Co, Sb, and B in a total amount of from 0.01 mass % to 10 mass % because, in the same way as Mg and Ca, they improve the stability of corrosion products and have an effect of delaying progression of corrosion.

The interfacial alloy layer is present at the interface with the base steel sheet and, as previously mentioned, is an Fe—Al compound and/or an Fe—Al—Si compound that is inevitably formed by alloying reaction between Fe in the surface of the base steel sheet and Al and/or Si in the molten bath. Since the interfacial alloy layer is hard and brittle, it may act as a start point for cracks during working if it grows thick. Therefore, the thickness of the interfacial alloy layer is preferably minimized.

The interfacial alloy layer and the main layer can be examined by using a scanning electron microscope or the like to observe a polished and/or etched cross-section of the hot-dip coating. Although there are various methods for polishing and etching the cross-section, there is no specific limitation on which method is used as long as the method is normally used for observing hot-dip coating cross-sections. Furthermore, regarding observation conditions using a scanning electron microscope, it is possible to clearly observe the alloy layer and the main layer, for example, in a backscattered electron image at a magnification of ×1,000 or more, with an acceleration voltage of 15 kV.

The presence or absence of Mg and one or more selected from Ca, Mn, V, Cr, Mo, Ti, Sr, Ni, Co, Sb, and B in the main layer can be confirmed by, for example, performing penetration analysis of the hot-dip coating using a glow discharge emission analyzer. However, use of a glow discharge emission analyzer is only intended as an example, and any other methods enabling examination of the presence and distribution of Mg, Ca, Mn, V, Cr, Mo, Ti, Sr, Ni, Co, Sb, and B in the main layer of the hot-dip coating can be adopted.

Furthermore, it is preferable that the aforementioned one or more selected from Ca, Mn, V, Cr, Mo, Ti, Sr, Ni, Co, Sb, and B form an intermetallic compound with one or more selected from Zn, Al, and Si in the main layer of the hot-dip coating. During the process of forming the hot-dip coating, the α-Al phase solidifies before the Zn-rich phase, and therefore the intermetallic compound is discharged from the α-Al phase during the solidification process and gathers in the Zn-rich phase in the main layer of the hot-dip coating. Since the Zn-rich phase corrodes before the α-Al phase, the one or more selected from Ca, Mn, V, Cr, Mo, Ti, Sr, Ni, Co, Sb, and B are taken into the corrosion products. As a result, it is possible to more effectively stabilize the corrosion products in the initial stage of corrosion. Furthermore, it is more preferable for Si to be included in the intermetallic compound because this means that the intermetallic compound absorbs Si within the hot-dip coating to reduce excessive Si in the main layer of the hot-dip coating and, as a result, a decrease in bending workability caused by formation of non-solute Si (Si phase) in the main layer of the hot-dip coating can be prevented.

The following methods may be used to confirm whether Mg or one or more selected from Ca, Mn, V, Cr, Mo, Ti, Sr, Ni, Co, Sb, and B form an intermetallic compound with one or more selected from Zn, Al, and Si. Examples of methods that can be used include a method of detecting such intermetallic compounds by wide angle X-ray diffraction from the surface of the hot-dip coated steel sheet and a method of detecting such intermetallic compounds by performing electron beam diffraction with a transmission electron microscope on a cross-section of the hot-dip coating. Moreover, as long as such intermetallic compounds can be detected, any other method can be used.

The thickness of the hot-dip coating of the disclosed hot-dip Al—Zn—Mg—Si coated steel sheet is preferably 15 μm or more and 27 μm or less. In general, corrosion resistance tends to become poorer as the thickness of the hot-dip coating is reduced, whereas workability tends to become poorer as the thickness of the hot-dip coating is increased.

The thickness of the interfacial alloy layer is preferably 1 μm or less. This is because high workability and better worked part corrosion resistance can be achieved when the thickness of the interfacial alloy layer is 1 μm or less. For example, by setting the Si content in the hot-dip coating as greater than 0.6 mass % as previously described, growth of the interfacial alloy layer can be inhibited, and thus the thickness of the interfacial alloy layer can be restricted to 1 μm or less.

The thicknesses of the hot-dip coating and the interfacial alloy layer can be obtained by any method that enables accurate determination of these thicknesses. For example, each of these thicknesses may be determined by observing a cross-section of the hot-dip Al—Zn—Mg—Si coated steel sheet under an SEM, measuring the thickness at 3 locations in each of 3 fields of view, and then calculating the average of the thicknesses at these 9 measurement locations.

The disclosed hot-dip Al—Zn—Mg—Si coated steel sheet may be a surface-treated steel sheet that further includes a chemical conversion treatment coating and/or a coating film at the surface thereof.

It should be noted that no specific limitations are placed on the base steel sheet used in the disclosed hot-dip Al—Zn—Mg—Si coated steel sheet. For example, the base steel sheet is not limited to being a steel sheet that is the same as used in a typical hot-dip Al—Zn alloy coated steel sheet, and may alternatively be a high tensile strength steel sheet or the like.

(Method of Producing Hot-Dip Al—Zn—Mg—Si Coated Steel Sheet)

The following describes the disclosed method of producing a hot-dip Al—Zn—Mg—Si coated steel sheet.

The disclosed method of producing a hot-dip Al—Zn—Mg—Si coated steel sheet includes hot-dip coating a base steel sheet by immersing the base steel sheet in a molten bath containing from 25 mass % to 80 mass % of Al, from greater than 0.6 mass % to 15 mass % of Si, and from greater than 0.1 mass % to 25 mass % of Mg, the balance being Zn and incidental impurities, subsequently cooling a resultant hot-dip coated steel sheet to a first cooling temperature at an average cooling rate of less than 10° C./sec, the first cooling temperature being no higher than a bath temperature of the molten bath and no lower than 50° C. below the bath temperature, and then cooling the hot-dip coated steel sheet from the first cooling temperature to 380° C. at an average cooling rate of 10° C./sec or more.

The disclosed production method enables production of a hot-dip Al—Zn—Mg—Si coated steel sheet having good corrosion resistance in flat parts and edge parts, and also having excellent worked part corrosion resistance.

In the disclosed method of producing a hot-dip Al—Zn—Mg—Si coated steel sheet, normally a method is adopted in which production is carried out in a continuous galvanizing line (CGL), but the disclosed production method is not specifically limited thereto.

No specific limitations are placed on the type of base steel sheet used for the disclosed hot-dip Al—Zn—Mg—Si coated steel sheet. For example, a hot rolled steel sheet or steel strip subjected to acid pickling descaling, or a cold rolled steel sheet or steel strip obtained by cold rolling the hot rolled steel sheet or steel strip may be used.

Moreover, no specific limitations are placed on conditions of pretreatment and annealing processes, and any method may be adopted.

The hot dip coating conditions may be in accordance with a conventional method without any specific limitations as long as an hot-dip Al—Zn alloy coating can be formed on the base steel sheet. For example, the base steel sheet may be subjected to reduction annealing, then cooled to a temperature close to the temperature of the molten bath, immersed in the molten bath, and then subjected to wiping to form a hot-dip coating of a desired thickness.

The molten bath for hot-dip coating has a composition containing from 25 mass % to 80 mass % of Al, from greater than 0.6 mass % to 15 mass % of Si, and from greater than 0.1 mass % to 25 mass % of Mg, the balance being Zn and incidental impurities.

The molten bath may further contain Ca for the purpose of further improving corrosion resistance.

In addition, the molten bath may contain one or more selected from Mn, V, Cr, Mo, Ti, Sr, Ni, Co, Sb, and B in a total amount of from 0.01 mass % to 10 mass %. Setting the composition of the molten bath as described above enables formation of the hot-dip coating.

No specific limitations are placed on the temperature of the molten bath other than being a temperature that enables hot-dip Al—Zn—Mg—Si coating without solidification of the molten bath, and a commonly known molten bath temperature may be adopted. For example, the temperature of a molten bath in which the Al concentration is 55 mass % is preferably from 575° C. to 620° C., and more preferably from 580° C. to 605° C.

As mentioned above, the hot-dip Al—Zn alloy coating includes an interfacial alloy layer present at an interface with the base steel sheet, and a main layer present on the interfacial alloy layer. Although the composition of the main layer has slightly lower Al and Si contents at the interfacial alloy layer side thereof, as a whole, the composition is substantially the same as the composition of the molten bath. Therefore, the composition of the main layer of the hot-dip coating can be precisely controlled by controlling the composition of the molten bath.

In the disclosed production method, the steel sheet resulting from the hot dip coating is cooled to the first cooling temperature at an average cooling rate of less than 10° C./sec, and is then cooled from the first cooling temperature to 380° C. at an average cooling rate of 10° C./sec or more. Through our research, we realized that $Mg_2Si$ is readily formed up until a temperature region roughly from the bath temperature of the molten bath to 50° C. below the bath temperature (first cooling temperature). Therefore, by restricting the cooling rate to an average value of less than 10° C./sec until the first cooling temperature, the period of time during which $Mg_2Si$ is formed in the main layer of the hot-dip coating is extended, thereby maximizing the amount of $Mg_2Si$ that is formed, and $Mg_2Si$ is finely and uniformly dispersed throughout the main layer of the hot-dip coating without uneven distribution, which enables excellent worked part corrosion resistance to be achieved. On the other hand, we realized that single phase Si readily precipitates in a temperature region from the first cooling temperature to 380° C. Accordingly, precipitation of single phase Si can be inhibited by maintaining a cooling rate with an average value of 10° C./sec or more from the first cooling temperature to 380° C.

From a viewpoint of more reliably preventing precipitation of single phase Si, the average cooling rate from the first cooling temperature to 380° C. is preferably 20° C./sec or more, and more preferably 40° C./sec or more.

It should be noted that in the disclosed production method, with the exception of cooling conditions during and after the hot dip coating, a hot-dip Al—Zn—Mg—Si coated steel sheet may be produced in accordance with a conventional method without any specific limitations.

For example, a chemical conversion treatment coating may be formed on the surface of the hot-dip Al—Zn—Mg—Si coated steel sheet (chemical conversion treatment process) or a coating film may be formed on the surface of the hot-dip Al—Zn—Mg—Si coated steel sheet in a separate coating line (coating film formation process).

The chemical conversion treatment coating can be formed by a chromating treatment or a chromium-free chemical conversion treatment where, for example, a chromating treatment liquid or a chromium-free chemical conversion treatment liquid is applied, and without water washing, drying treatment is performed with a steel sheet temperature of 80° C. to 300° C. These chemical conversion treatment coatings may have a single-layer structure or a multilayer structure, and in the case of a multilayer structure, chemical conversion treatment can be performed multiple times sequentially.

Methods of forming the coating film include roll coater coating, curtain flow coating, and spray coating. The coating film can be formed by applying a coating material containing organic resin, and then heating and drying the coating material by hot air drying, infrared heating, induction heating, or other means.

EXAMPLES

The following describes examples of the disclosed techniques.

Example 1

Hot-dip Al—Zn—Mg—Si coated steel sheet samples 1 to 57 were each produced in a continuous galvanizing line (CGL) using, as a base steel sheet, a cold rolled steel sheet of 0.5 mm in thickness that was produced by a conventional method.

Production conditions (molten bath temperature, first cooling temperature, and cooling rate) and hot-dip coating conditions (composition, major diameter of $Mg_2Si$, minor diameter/major diameter of $Mg_2Si$, thickness of hot-dip coating, left side of formula (1), left side of formula (2), $Mg_2Si$ content in main layer, $Mg_2Si$ area ratio in main layer cross-section, intensity ratio of $Mg_2Si$ relative to Al, and thickness of interfacial alloy layer) are shown in Table 1.

The bath temperature of the molten bath was 590° C. in production of all the above hot-dip Al—Zn—Mg—Si coated steel sheet samples.

Sample 10 was subjected to treatment of being held at 200° C. for 30 minutes after hot-dip coating. The compositions of hot-dip coatings in samples 11 to 13, 20, and 21 were within the same ranges as disclosed in PTL 2, whereas the compositions of hot-dip coatings in samples 28, 29, and 32 were within the same ranges as disclosed in PTL 3.

Minor Diameter and Major Diameter of $Mg_2Si$

The major and minor diameters of $Mg_2Si$ were determined for each hot-dip Al—Zn—Mg—Si coated steel sheet sample by imaging the surface of the hot-dip coating using an optical microscope (×100 magnification), randomly selecting five $Mg_2Si$ particles, measuring the major diameter and minor diameter of each of the selected $Mg_2Si$ particles, and calculating the averages of these measured major diameters and minor diameters. The major diameter (μm) and ratio of minor diameter relative to major diameter that were determined for $Mg_2Si$ are shown in Table 1.

Dendrite Diameter

The dendrite diameter was determined for each hot-dip Al—Zn—Mg—Si coated steel sheet sample by observing a polished surface of a main layer of the hot-dip coating at ×200 magnification using an SEM, selecting a region in which at least three dendrite arms were aligned in a randomly selected field of view, measuring the distance along the direction of alignment of the arms, and then dividing the measured distance by the number of dendrite arms. The dendrite diameter was measured at three locations in one field of view and the mean of the measured dendrite diameters was calculated to determine the mean dendrite diameter. The determined dendrite diameter is shown in Table 1.

(Evaluation of Hot-Dip Coating Corrosion Resistance)

(1) Evaluation of Flat Part and Edge Part Corrosion Resistance

Figure 6:
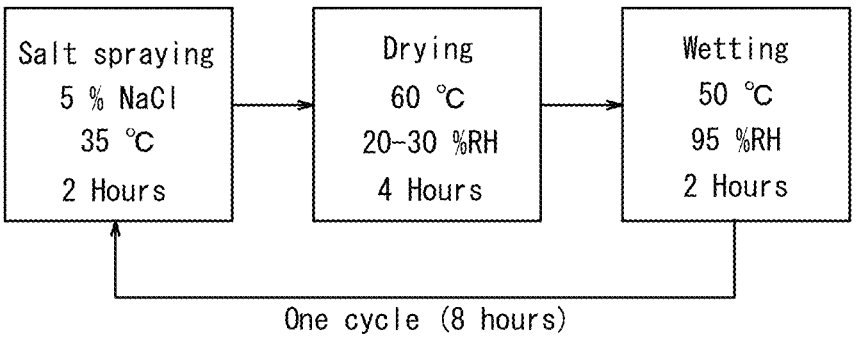
FIG. 6 illustrates the procedure of a Japan Automotive Standards Organization Cyclic Corrosion Test (JASO-CCT)

Each hot-dip Al—Zn—Mg—Si coated steel sheet sample was subjected to a Japan Automotive Standards Organization Cyclic Corrosion Test (JASO-CCT). Each cycle of the JASO-CCT included salt spraying, drying, and wetting under specific conditions as illustrated in FIG. 6.

The number of cycles until red rust formed was counted with respect to a flat part and an edge part of each of the samples, and was then evaluated in accordance with the following standard.

Excellent: Red rust formation cycle count≥600 cycles

Satisfactory: 400 Cycles≤Red rust formation cycle count<600 Cycles

Unsatisfactory: 300 Cycles≤Red rust formation cycle count<400 Cycles

Poor: Red rust formation cycle count<300 Cycles (2) Evaluation of Bent Worked Part Corrosion Resistance Each hot-dip Al—Zn—Mg—Si coated steel sheet sample was worked by 180° bending to sandwich three sheets of the same sheet thickness at the inside (3T bending), and was then subjected to a Japan Automotive Standards Organization Cyclic Corrosion Test (JASO-CCT) at the outside of the bend. Each cycle of the JASO-CCT included salt spraying, drying, and wetting under specific conditions as illustrated in FIG. 6.

The number of cycles until red rust formed was counted with respect to the worked part of each of the samples, and was then evaluated in accordance with the following standard.

Excellent: Red rust formation cycle count≥600 Cycles

Satisfactory: 400 Cycles≤Red rust formation cycle count<600 Cycles

Unsatisfactory: 300 Cycles≤Red rust formation cycle count<400 Cycles

Poor: Red rust formation cycle count<300 Cycles

TABLE 1

| | Hot-dip coating | | | | | | | | | | | | | Production conditions | | | | Evaluation Hot-dip coating corrosion resistance | | | |
|---|---|---|---|---|---|---|---|---|---|---|---|---|---|---|---|---|---|---|---|---|---|
| | Composition (mess %) | | | $Mg_2Si$ major diameter | $Mg_2Si$ minor diameter/ major diameter | Coat-ing thick-ness | Den-drite dia-me-ter | Left side of for-mula | $Mg_2Si$ con-tent (mass | $Mg_2Si$ area ratio | $Mg_2Si$/ Al inten-sity ratio | Inter-facial alloy layer thick-ness | Left side of for-mula | Molten bath tem-pera-ture | First cooling tem-pera-ture | Average cooling rate (° C./sec) To first cooling tem-pera-ture | From first cooling tem-pera-ture to 380° C. | | | | |
| No. | Al | Mg | Si | (μm) | | (μm) | (μm) | (2) | %) | (%) | | (μm) | (1) | (° C.) | (° C.) | | | Flat part | Edge part | Worked part | Remarks |
| 1 | 55 | 1.1 | 0.5 | No $Mg_2Si$ | No $Mg_2Si$ | 24 | 12.2 | 20 | 0.0 | 0.0 | 0.00 | 1.2 | −11.0 | 590 | 540 | 5 | 23 | Poor | Poor | Poor | Comparative example |
| 2 | 55 | 3.2 | 0.5 | No $Mg_2Si$ | No $Mg_2Si$ | 23 | 11.0 | 2.1 | 0.0 | 0.0 | 0.00 | 1.2 | −32.0 | 590 | 540 | 5 | 23 | Poor | Poor | Poor | Comparative example |
| 3 | 55 | 5.6 | 0.5 | No $Mg_2Si$ | No $Mg_2Si$ | 21 | 10.5 | 2.0 | 0.0 | 0.0 | 0.00 | 1.2 | −56.0 | 590 | 540 | 5 | 23 | Unsatisfactory | Poor | Poor | Comparative example |
| 4 | 55 | 7.3 | 0.5 | No $Mg_2Si$ | No $Mg_2Si$ | 22 | 12.2 | 1.8 | 0.0 | 0.0 | 0.00 | 1.2 | −73.0 | 590 | 540 | 5 | 23 | Unsatisfactory | Poor | Poor | Comparative example |
| 5 | 55 | 1.1 | 1.1 | 7 | 0.2 | 22 | 11.2 | 2.0 | 1.4 | 1.2 | 0.01 | 1.0 | 2.2 | 590 | 540 | 5 | 23 | Satisfactory | Satisfactory | Satisfactory | Example |
| 6 | 55 | 3.2 | 1.1 | 8 | 0.2 | 23 | 11.6 | 2.0 | 1.4 | 1.2 | 0.01 | 1.0 | 6.4 | 590 | 540 | 5 | 23 | Satisfactory | Satisfactory | Satisfactory | Example |
| 7 | 55 | 5.6 | 1.1 | 6 | 0.1 | 26 | 10.9 | 2.4 | 1.4 | 1.2 | 0.01 | 1.0 | 11.2 | 590 | 540 | 5 | 23 | Satisfactory | Satisfactory | Satisfactory | Example |
| 8 | 55 | 10.5 | 1.1 | 5 | 0.1 | 22 | 10.3 | 2.1 | 1.4 | 1.2 | 0.01 | 1.0 | 21.0 | 590 | 540 | 5 | 23 | Satisfactory | Satisfactory | Satisfactory | Example |
| 9 | 55 | 0.0 | 1.5 | No $Mg_2Si$ | No $Mg_2Si$ | 24 | 11.4 | 2.1 | 0.0 | 0.0 | 0.00 | 0.9 | 0.0 | 590 | 540 | 5 | 23 | Unsatisfactory | Poor | Poor | Comparative example |
| 10 | 55 | 0.0 | 1.5 | No $Mg_2Si$ | No $Mg_2Si$ | 23 | 10.8 | 2.1 | 0.0 | 0.0 | 0.00 | 0.9 | 0.0 | 590 | 540 | 5 | 23 | Poor | Poor | Unsatisfactory | Comparative example |
| 11 | 55 | 1.1 | 1.5 | 9 | 0.2 | 21 | 15.7 | 1.3 | 1.7 | 4.2 | 0.01 | 0.9 | 1.2 | 590 | 540 | 5 | 23 | Unsatisfactory | Poor | Poor | Comparative example |
| 12 | 55 | 1.8 | 1.5 | 6 | 0.2 | 22 | 12.3 | 1.8 | 2.8 | 5.8 | 0.01 | 0.9 | 2.0 | 590 | 540 | 5 | 23 | Satisfactory | Satisfactory | Satisfactory | Example |
| 13 | 55 | 3.2 | 1.5 | 7 | 0.1 | 21 | 11.1 | 1.9 | 2.5 | 5.3 | 0.01 | 0.9 | 3.6 | 590 | 540 | 5 | 23 | Satisfactory | Satisfactory | Satisfactory | Example |
| 14 | 55 | 5.6 | 1.5 | 8 | 0.2 | 24 | 9.6 | 2.5 | 2.5 | 5.3 | 0.01 | 0.9 | 6.2 | 590 | 540 | 5 | 23 | Satisfactory | Satisfactory | Satisfactory | Example |
| 15 | 55 | 7.3 | 1.5 | 6 | 0.2 | 22 | 10.4 | 2.1 | 2.5 | 5.3 | 0.01 | 0.9 | 8.1 | 590 | 540 | 5 | 23 | Satisfactory | Satisfactory | Satisfactory | Example |
| 16 | 55 | 10.5 | 1.5 | 7 | 0.2 | 23 | 11.6 | 2.0 | 2.5 | 5.3 | 0.01 | 0.9 | 11.7 | 590 | 540 | 5 | 23 | Satisfactory | Satisfactory | Satisfactory | Example |
| 17 | 55 | 14.2 | 1.5 | 7 | 0.2 | 22 | 10.8 | 2.0 | 2.5 | 5.3 | 0.01 | 0.9 | 15.8 | 590 | 540 | 5 | 23 | Satisfactory | Satisfactory | Satisfactory | Example |
| 18 | 55 | 0.0 | 2.3 | No $Mg_2Si$ | No $Mg_2Si$ | 20 | 12.5 | 1.6 | 0.0 | 0.0 | 0.00 | 0.7 | 0.0 | 590 | 540 | 5 | 23 | Poor | Poor | Poor | Comparative example |
| 19 | 55 | 0.2 | 2.3 | No $Mg_2Si$ | No $Mg_2Si$ | 22 | 15.5 | 1.4 | 0.3 | 1.3 | 0.00 | 0.7 | 0.1 | 590 | 540 | 5 | 23 | Poor | Poor | Poor | Comparative example |
| 20 | 55 | 2.3 | 2.3 | 8 | 0.2 | 23 | 16.9 | 1.4 | 3.6 | 6.9 | 0.02 | 0.7 | 1.4 | 590 | 540 | 5 | 23 | Unsatisfactory | Poor | Poor | Comparative example |
| 21 | 55 | 3.2 | 2.3 | 6 | 0.2 | 25 | 10.4 | 2.4 | 4.6 | 8.1 | 0.02 | 0.7 | 1.9 | 590 | 540 | 5 | 23 | Satisfactory | Satisfactory | Satisfactory | Example |
| 22 | 55 | 5.6 | 2.3 | 7 | 0.2 | 21 | 11.0 | 1.9 | 4.6 | 8.1 | 0.02 | 0.7 | 3.3 | 590 | 540 | 5 | 23 | Satisfactory | Satisfactory | Satisfactory | Example |
| 23 | 55 | 5.6 | 2.4 | 7 | 0.2 | 21 | 11.0 | 1.9 | 3.6 | 6.9 | 0.02 | 0.6 | 3.1 | 590 | 560 | 5 | 23 | Excellent | Satisfactory | Excellent | Example |

TABLE 1-continued

| | Hot-dip coating | | | | | | | | | | | | | Production conditions | | | | Evaluation Hot-dip coating corrosion resistance | | | |
|---|---|---|---|---|---|---|---|---|---|---|---|---|---|---|---|---|---|---|---|---|---|
| | Composition (mess %) | | | $Mg_2Si$ major diameter | $Mg_2Si$ minor diameter/ major diameter | Coating thickness | Dendrite diameter | Left side of formula | $Mg_2Si$ content (mass %) | $Mg_2Si$ area ratio | $Mg_2Si$/Al intensity ratio | Interfacial alloy layer thickness | Left side of formula | Molten bath temperature | First cooling temperature | To first cooling temperature | Average cooling rate (° C./sec) From first cooling temperature to 380° C. | | | | |
| No. | Al | Mg | Si | (μm) | | (μm) | (μm) | (2) | | (%) | | (μm) | (1) | (° C.) | (° C.) | | | Flat part | Edge part | Worked part | Remarks |
| 25 | 55 | 7.3 | 2.3 | 8 | 0.2 | 23 | 10.6 | 2.2 | 4.6 | 8.1 | 0.02 | 0.7 | 4.3 | 590 | 540 | 5 | 23 | Satisfactory | Satisfactory | Satisfactory | Example |
| 26 | 55 | 14.2 | 2.3 | 6 | 0.2 | 24 | 12.4 | 1.9 | 4.6 | 8.1 | 0.02 | 0.7 | 8.4 | 590 | 540 | 5 | 23 | Satisfactory | Satisfactory | Satisfactory | Example |
| 27 | 55 | 19.4 | 2.3 | 7 | 0.2 | 24 | 10.2 | 2.4 | 4.6 | 8.1 | 0.02 | 0.7 | 11.4 | 590 | 540 | 5 | 23 | Satisfactory | Satisfactory | Satisfactory | Example |
| 28 | 55 | 24.3 | 2.3 | 7 | 0.1 | 22 | 10.4 | 2.1 | 4.6 | 8.1 | 0.02 | 0.7 | 14.3 | 590 | 540 | 5 | 23 | Satisfactory | Satisfactory | Satisfactory | Example |
| 29 | 55 | 28.5 | 2.3 | 8 | 0.1 | 26 | 10.7 | 2.4 | 4.6 | 8.1 | 0.02 | 0.7 | 16.8 | 590 | 540 | 5 | 23 | Unsatisfactory | Unsatisfactory | Unsatisfactory | Comparative example |
| 30 | 55 | 3.2 | 3.1 | 13 | 0.5 | 19 | 15.2 | 1.3 | 5.1 | 8.7 | 0.03 | 0.7 | 1.3 | 590 | 540 | 15 | 15 | Unsatisfactory | Poor | Poor | Comparative example |
| 31 | 55 | 4.5 | 3.1 | 9 | 0.2 | 24 | 9.9 | 2.4 | 6.8 | 10.5 | 0.02 | 0.7 | 1.8 | 590 | 540 | 5 | 23 | Excellent | Satisfactory | Excellent | Example |
| 32 | 55 | 4.5 | 3.1 | 9 | 0.2 | 24 | 9.9 | 2.4 | 5.1 | 8.5 | 0.02 | 0.6 | 1.8 | 590 | 560 | 5 | 25 | Excellent | Satisfactory | Excellent | Example |
| 34 | 45 | 4.8 | 2.9 | 8 | 0.3 | 23 | 10.3 | 2.2 | 6.3 | 10.0 | 0.03 | 0.7 | 2.1 | 590 | 540 | 5 | 23 | Excellent | Satisfactory | Excellent | Example |
| 35 | 65 | 4.6 | 3.0 | 9 | 0.2 | 22 | 11.7 | 1.9 | 6.6 | 10.2 | 0.03 | 0.7 | 1.9 | 590 | 540 | 5 | 23 | Excellent | Satisfactory | Excellent | Example |
| 36 | 55 | 5.6 | 3.1 | 8 | 0.3 | 24 | 19.4 | 1.2 | 6.8 | 10.5 | 0.03 | 0.7 | 2.2 | 590 | 540 | 16 | 16 | Unsatisfactory | Unsatisfactory | Unsatisfactory | Comparative example |
| 37 | 55 | 5.6 | 3.1 | 8 | 0.3 | 22 | 17.1 | 1.3 | 6.8 | 10.5 | 0.03 | 0.7 | 2.2 | 590 | 540 | 18 | 18 | Unsatisfactory | Unsatisfactory | Unsatisfactory | Comparative example |
| 38 | 55 | 5.6 | 3.1 | 7 | 0.2 | 21 | 13.2 | 1.6 | 6.8 | 10.5 | 0.03 | 0.7 | 2.2 | 590 | 540 | 5 | 23 | Excellent | Satisfactory | Excellent | Example |
| 39 | 55 | 5.6 | 3.1 | 8 | 0.2 | 22 | 10.8 | 2.0 | 6.8 | 10.5 | 0.03 | 0.7 | 2.2 | 590 | 540 | 5 | 38 | Excellent | Satisfactory | Excellent | Example |
| 40 | 55 | 5.6 | 3.1 | 8 | 0.2 | 22 | 10.8 | 2.0 | 5.9 | 9.5 | 0.03 | 0.6 | 2.2 | 590 | 560 | 5 | 38 | Excellent | Satisfactory | Excellent | Example |
| 42 | 55 | 7.3 | 3.1 | 8 | 0.2 | 25 | 9.1 | 2.7 | 6.8 | 10.5 | 0.03 | 0.7 | 2.9 | 590 | 540 | 5 | 23 | Satisfactory | Satisfactory | Satisfactory | Example |
| 43 | 55 | 10.5 | 3.1 | 8 | 0.2 | 22 | 10.5 | 2.1 | 6.8 | 10.5 | 0.03 | 0.7 | 4.2 | 590 | 540 | 5 | 23 | Satisfactory | Satisfactory | Satisfactory | Example |
| 44 | 55 | 14.2 | 3.1 | 8 | 0.2 | 25 | 9.9 | 2.5 | 6.8 | 10.5 | 0.03 | 0.7 | 5.7 | 590 | 540 | 5 | 23 | Satisfactory | Satisfactory | Satisfactory | Example |
| 45 | 55 | 19.4 | 3.1 | 9 | 0.2 | 23 | 9.6 | 2.4 | 6.8 | 10.5 | 0.03 | 0.7 | 7.8 | 590 | 540 | 5 | 23 | Satisfactory | Satisfactory | Satisfactory | Example |
| 46 | 55 | 24.3 | 3.1 | 7 | 0.2 | 22 | 9.1 | 2.4 | 6.8 | 10.5 | 0.03 | 0.7 | 9.7 | 590 | 540 | 5 | 23 | Satisfactory | Satisfactory | Satisfactory | Example |
| 47 | 55 | 28.5 | 3.1 | 8 | 0.1 | 21 | 9.2 | 2.3 | 6.8 | 10.5 | 0.03 | 0.7 | 11.4 | 590 | 540 | 5 | 23 | Unsatisfactory | Unsatisfactory | Unsatisfactory | Comparative example |
| 48 | 55 | 7.3 | 5.9 | 14 | 0.5 | 20 | 16.4 | 1.2 | 11.5 | 14.9 | 0.06 | 0.7 | 1.4 | 590 | 540 | 15 | 15 | Unsatisfactory | Poor | Poor | Comparative example |
| 49 | 55 | 10.5 | 5.9 | 7 | 0.2 | 22 | 9.5 | 2.3 | 14.5 | 17.4 | 0.07 | 0.7 | 2.0 | 590 | 540 | 5 | 23 | Satisfactory | Satisfactory | Satisfactory | Example |
| 50 | 55 | 14.2 | 5.9 | 8 | 0.2 | 23 | 10.6 | 2.2 | 14.5 | 17.4 | 0.07 | 0.7 | 2.7 | 590 | 540 | 5 | 23 | Satisfactory | Satisfactory | Satisfactory | Example |
| 51 | 55 | 19.4 | 5.9 | 6 | 0.2 | 21 | 10.3 | 2.0 | 14.5 | 17.4 | 0.07 | 0.7 | 3.7 | 590 | 540 | 5 | 23 | Satisfactory | Satisfactory | Satisfactory | Example |
| 52 | 55 | 24.3 | 5.9 | 8 | 0.2 | 21 | 9.4 | 2.2 | 14.5 | 17.4 | 0.07 | 0.7 | 4.6 | 590 | 540 | 5 | 23 | Satisfactory | Satisfactory | Satisfactory | Example |
| 53 | 55 | 28.5 | 5.9 | 7 | 0.1 | 24 | 11.1 | 2.2 | 14.5 | 17.4 | 0.07 | 0.7 | 5.4 | 590 | 540 | 5 | 23 | Unsatisfactory | Unsatisfactory | Unsatisfactory | Comparative example |

TABLE 1-continued

| | Hot-dip coating | | | | | | | | | | | | Production conditions | | | | Evaluation Hot-dip coating corrosion resistance | | | |
|---|---|---|---|---|---|---|---|---|---|---|---|---|---|---|---|---|---|---|---|---|
| | Composition (mess %) | | | $Mg_2Si$ major diameter | $Mg_2Si$ minor diameter/ major diameter | Coating thickness | Dendrite diameter | Left side of formula | $Mg_2Si$ content (mass %) | $Mg_2Si$ area ratio | $Mg_2Si$/Al intensity ratio | Interfacial alloy layer thickness | Left side of formula | Molten bath temperature | First cooling temperature | Average cooling rate (° C./sec) To first cooling temperature | Average cooling rate (° C./sec) From first cooling temperature to 380° C. | | | |
| No. | Al | Mg | Si | (μm) | | (μm) | (μm) | (2) | | (%) | | (μm) | (1) | (° C.) | (° C.) | | | Flat part | Edge part | Worked part | Remarks |
| 54 | 55 | 14.2 | 8.5 | 7 | 0.2 | 22 | 9.7 | 2.3 | 21.6 | 22.7 | 0.11 | 0.7 | 1.8 | 590 | 540 | 5 | 23 | Satisfactory | Satisfactory | Satisfactory | Example |
| 55 | 55 | 19.4 | 8.5 | 7 | 0.2 | 25 | 10.5 | 2.4 | 21.6 | 22.7 | 0.11 | 0.7 | 2.5 | 590 | 540 | 5 | 23 | Satisfactory | Satisfactory | Satisfactory | Example |
| 56 | 55 | 24.3 | 8.5 | 7 | 0.2 | 23 | 9.3 | 2.5 | 21.6 | 22.7 | 0.11 | 0.7 | 3.1 | 590 | 540 | 5 | 23 | Satisfactory | Satisfactory | Satisfactory | Example |
| 57 | 55 | 28.5 | 8.5 | 6 | 0.2 | 21 | 8.9 | 2.4 | 21.6 | 22.7 | 0.11 | 0.7 | 3.6 | 590 | 540 | 5 | 0 | Unsatisfactory | Unsatisfactory | Unsatisfactory | Comparative example |
| 58 | 55 | 24.3 | 13.5 | 7 | 0.2 | 24 | 9.8 | 2.4 | 35.2 | 31.4 | 0.18 | 0.7 | 1.9 | 590 | 540 | 5 | 0 | Satisfactory | Satisfactory | Satisfactory | Example |
| 59 | 55 | 28.5 | 13.5 | 8 | 0.1 | 22 | 9.0 | 2.4 | 35.2 | 31.4 | 0.18 | 0.7 | 2.2 | 590 | 540 | 5 | 23 | Unsatisfactory | Unsatisfactory | Unsatisfactory | Comparative example |
| 60 | 55 | 24.3 | 16.2 | 8 | 0.1 | 23 | 8.7 | 2.6 | 38.4 | 33.3 | 0.19 | 0.7 | 1.6 | 590 | 540 | 5 | 23 | Unsatisfactory | Poor | Poor | Comparative example |
| 61 | 55 | 28.5 | 16.2 | 7 | 0.1 | 20 | 9.6 | 2.1 | 42.6 | 35.7 | 0.21 | 0.7 | 1.8 | 590 | 540 | 5 | 23 | Unsatisfactory | Unsatisfactory | Unsatisfactory | Comparative example |
| 62 | 55 | 3.2 | 1.5 | 7 | 0.1 | 17 | 10.9 | 1.6 | 2.4 | 5.2 | 0.01 | 0.9 | 3.6 | 590 | 540 | 5 | 23 | Satisfactory | Satisfactory | Satisfactory | Example |
| 63 | 55 | 5.6 | 1.5 | 8 | 0.2 | 15 | 9.6 | 1.6 | 2.6 | 5.5 | 0.01 | 0.9 | 6.2 | 590 | 540 | 5 | 23 | Satisfactory | Satisfactory | Satisfactory | Example |
| 64 | 55 | 7.3 | 1.5 | 6 | 0.2 | 16 | 10.1 | 1.6 | 2.5 | 5.3 | 0.01 | 0.8 | 8.1 | 590 | 540 | 5 | 23 | Satisfactory | Satisfactory | Satisfactory | Example |
| 65 | 55 | 10.5 | 1.5 | 7 | 0.2 | 17 | 10.8 | 1.6 | 2.6 | 5.5 | 0.01 | 0.9 | 11.7 | 590 | 540 | 5 | 23 | Satisfactory | Satisfactory | Satisfactory | Example |
| 66 | 55 | 14.2 | 1.5 | 7 | 0.2 | 17 | 10.7 | 1.6 | 2.5 | 5.3 | 0.01 | 0.9 | 15.8 | 590 | 540 | 5 | 23 | Satisfactory | Satisfactory | Satisfactory | Example |
| 68 | 55 | 7.3 | 3.1 | 8 | 0.2 | 15 | 9.1 | 1.6 | 6.8 | 10.5 | 0.03 | 0.7 | 2.9 | 590 | 540 | 5 | 23 | Satisfactory | Satisfactory | Satisfactory | Example |
| 69 | 30 | 4.8 | 2.9 | 6 | 0.2 | 17 | 10.5 | 1.6 | 6.4 | 10.1 | 0.03 | 0.5 | 2.1 | 560 | 520 | 5 | 23 | Satisfactory | Satisfactory | Satisfactory | Example |
| 70 | 35 | 4.8 | 2.9 | 7 | 0.2 | 17 | 10.8 | 1.6 | 6.2 | 9.9 | 0.03 | 0.5 | 2.1 | 570 | 530 | 5 | 23 | Excellent | Satisfactory | Excellent | Example |
| 71 | 45 | 4.8 | 2.9 | 8 | 0.3 | 16 | 10.3 | 1.6 | 6.3 | 10.0 | 0.03 | 0.7 | 2.1 | 590 | 540 | 5 | 23 | Excellent | Satisfactory | Excellent | Example |
| 72 | 65 | 4.8 | 2.9 | 8 | 0.2 | 18 | 11.2 | 1.6 | 6.3 | 10.0 | 0.03 | 0.7 | 2.1 | 590 | 540 | 5 | 23 | Excellent | Satisfactory | Excellent | Example |
| 73 | 70 | 4.8 | 2.9 | 8 | 0.2 | 18 | 11.5 | 1.6 | 6.1 | 9.8 | 0.03 | 0.9 | 2.1 | 620 | 570 | 5 | 23 | Satisfactory | Satisfactory | Satisfactory | Example |
| 74 | 55 | 0.0 | 1.5 | No $Mg_2Si$ | No $Mg_2Si$ | 15 | 15.0 | 1.0 | 0.0 | 0.0 | 0.00 | 1.2 | 0.0 | 590 | 540 | 5 | 23 | Poor | Poor | Poor | Comparative example |

It can be seen from Table 1 that samples of the "Examples" had excellent corrosion resistance in flat parts, edge parts, and worked parts compared to the samples of the "Comparative examples".

Example 2

Some of the hot-dip Al—Zn—Mg—Si coated steel sheet samples produced in Example 1 (refer to Table 2 for the sample numbers) were subjected to formation of a urethane resin-based chemical conversion coating (CT-E-364 produced by Nihon Parkerizing Co., Ltd.). The coating weight of the chemical conversion coating was 1 g/m$^2$.

Production conditions (molten bath temperature, first cooling temperature, and cooling rate) and hot-dip coating conditions (composition, major diameter of $Mg_2Si$, minor diameter/major diameter of $Mg_2Si$, thickness of hot-dip coating, left side of formula (1), left side of formula (2), $Mg_2Si$ content in main layer, $Mg_2Si$ area ratio in main layer cross-section, intensity ratio of $Mg_2Si$ relative to Al, and thickness of interfacial alloy layer) are shown in Table 2.

(Evaluation of Chemical Conversion Corrosion Resistance)

(1) Evaluation of Flat Part and Edge Part Corrosion Resistance

Each hot-dip Al—Zn—Mg—Si coated steel sheet sample on which a chemical conversion coating had been formed was subjected to a Japan Automotive Standards Organization Cyclic Corrosion Test (JASO-CCT). Each cycle of the JASO-CCT included salt spraying, drying, and wetting under specific conditions as illustrated in FIG. 6.

The number of cycles until red rust formed was counted with respect to a flat part and an edge part of each of the samples, and was then evaluated in accordance with the following standard.

Excellent: Red rust formation cycle count≥700 Cycles

Satisfactory: 500 Cycles≤Red rust formation cycle count<700 Cycles

Unsatisfactory: 400 Cycles≤Red rust formation cycle count<500 Cycles

Poor: Red rust formation cycle count<400 Cycles (2) Evaluation of Bent Worked Part Corrosion Resistance Each hot-dip Al—Zn—Mg—Si coated steel sheet sample on which a chemical conversion coating had been formed was worked by 180° bending to sandwich three sheets of the same sheet thickness at the inside (3T bending), and was then subjected to a Japan Automotive Standards Organization Cyclic Corrosion Test (JASO-CCT) at the outside of the bend. Each cycle of the JASO-CCT included salt spraying, drying, and wetting under specific conditions as illustrated in FIG. 6.

The number of cycles until red rust formed was counted with respect to the worked part of each of the samples, and was then evaluated in accordance with the following standard.

Excellent: Red rust formation cycle count≥700 Cycles

Satisfactory: 500 Cycles≤Red rust formation cycle count<700 Cycles

Unsatisfactory: 400 Cycles≤Red rust formation cycle count<500 Cycles

Poor: Red rust formation cycle count<400 Cycles

TABLE 2

| | Hot-dip coating | | | | | | | | | | |
|---|---|---|---|---|---|---|---|---|---|---|---|
| | Composition (mass %) | | | $Mg_2Si$ major diameter | $Mg_2Si$ minor diameter/major | Coating thickness | Dendrite diameter | Left side of formula | $Mg_2Si$ content | $Mg_2Si$ area ratio | $Mg_2Si$/Al intensity |
| No. | Al | Mg | Si | (μm) | diameter | (μm) | (μm) | (2) | (mass %) | (%) | ratio |
| 1 | 55 | 5.6 | 0.5 | No $Mg_2Si$ | No $Mg_2Si$ | 21 | 10.5 | 2.0 | 0.0 | 0.0 | 0.00 |
| 2 | 55 | 7.3 | 0.5 | No $Mg_2Si$ | No $Mg_2Si$ | 22 | 12.2 | 1.8 | 0.0 | 0.0 | 0.00 |
| 3 | 55 | 3.2 | 1.1 | 8 | 0.2 | 23 | 11.6 | 2.0 | 1.4 | 1.2 | 0.01 |
| 4 | 55 | 5.6 | 1.1 | 6 | 0.1 | 26 | 10.9 | 2.4 | 1.4 | 1.2 | 0.01 |
| 5 | 55 | 0.0 | 1.5 | No $Mg_2Si$ | No $Mg_2Si$ | 24 | 11.4 | 2.1 | 0.0 | 0.0 | 0.00 |
| 6 | 55 | 0.0 | 1.5 | No $Mg_2Si$ | No $Mg_2Si$ | 23 | 10.8 | 2.1 | 0.0 | 0.0 | 0.00 |
| 7 | 55 | 1.1 | 1.5 | 9 | 0.2 | 21 | 15.7 | 1.3 | 1.7 | 4.2 | 0.01 |
| 8 | 55 | 1.8 | 1.5 | 6 | 0.2 | 22 | 12.3 | 1.8 | 2.5 | 5.3 | 0.01 |
| 9 | 55 | 5.6 | 1.5 | 8 | 0.2 | 24 | 9.6 | 2.5 | 2.5 | 5.3 | 0.01 |
| 10 | 55 | 10.5 | 1.5 | 7 | 0.2 | 23 | 11.6 | 2.0 | 2.5 | 5.3 | 0.01 |
| 11 | 55 | 0.0 | 2.3 | No $Mg_2Si$ | No $Mg_2Si$ | 20 | 12.5 | 1.6 | 0.0 | 0.0 | 0.00 |
| 12 | 55 | 0.2 | 2.3 | No $Mg_2Si$ | No $Mg_2Si$ | 22 | 15.5 | 1.4 | 0.3 | 1.3 | 0.00 |
| 13 | 55 | 3.2 | 2.3 | 6 | 0.2 | 25 | 10.4 | 2.4 | 4.6 | 8.1 | 0.02 |
| 14 | 55 | 5.6 | 2.4 | 7 | 0.2 | 21 | 11.0 | 1.9 | 3.6 | 6.9 | 0.02 |
| 16 | 55 | 7.3 | 2.3 | 8 | 0.2 | 23 | 10.6 | 2.2 | 4.6 | 8.1 | 0.02 |
| 17 | 55 | 19.4 | 2.3 | 7 | 0.2 | 24 | 10.2 | 2.4 | 4.6 | 8.1 | 0.02 |
| 18 | 55 | 28.5 | 2.3 | 8 | 0.1 | 26 | 10.7 | 2.4 | 4.6 | 8.1 | 0.02 |
| 19 | 55 | 4.5 | 3.1 | 9 | 0.2 | 24 | 9.9 | 2.4 | 5.1 | 8.5 | 0.02 |
| 21 | 55 | 5.6 | 3.1 | 8 | 0.3 | 24 | 19.4 | 1.2 | 6.8 | 10.5 | 0.03 |
| 22 | 55 | 5.6 | 3.1 | 8 | 0.3 | 22 | 17.1 | 1.3 | 6.8 | 10.5 | 0.03 |
| 23 | 55 | 5.6 | 3.1 | 7 | 0.2 | 21 | 13.2 | 1.6 | 6.8 | 10.5 | 0.03 |
| 24 | 55 | 5.6 | 3.1 | 8 | 0.2 | 22 | 10.8 | 2.0 | 6.8 | 10.5 | 0.03 |
| 25 | 55 | 5.6 | 3.1 | 8 | 0.2 | 22 | 10.8 | 2.0 | 5.9 | 9.5 | 0.03 |
| 27 | 55 | 10.5 | 3.1 | 8 | 0.2 | 22 | 10.5 | 2.1 | 6.8 | 10.5 | 0.03 |
| 28 | 55 | 19.4 | 3.1 | 9 | 0.2 | 23 | 9.6 | 2.4 | 6.8 | 10.5 | 0.03 |
| 29 | 55 | 28.5 | 3.1 | 8 | 0.1 | 21 | 9.2 | 2.3 | 6.8 | 10.5 | 0.03 |

TABLE 2-continued

| | | | | | | | | | | | |
|---|---|---|---|---|---|---|---|---|---|---|---|
| 30 | 55 | 7.3 | 5.9 | 14 | 0.5 | 20 | 16.4 | 1.2 | 11.5 | 14.9 | 0.06 |
| 31 | 55 | 10.5 | 5.9 | 7 | 0.2 | 22 | 9.5 | 2.3 | 14.5 | 17.4 | 0.07 |
| 32 | 55 | 19.4 | 5.9 | 6 | 0.2 | 21 | 10.3 | 2.0 | 14.5 | 17.4 | 0.07 |
| 33 | 55 | 24.3 | 5.9 | 8 | 0.2 | 21 | 9.4 | 2.2 | 14.5 | 17.4 | 0.07 |
| 34 | 55 | 28.5 | 5.9 | 7 | 0.1 | 24 | 11.1 | 2.2 | 14.5 | 17.4 | 0.07 |
| 35 | 55 | 14.2 | 8.5 | 7 | 0.2 | 22 | 9.7 | 2.3 | 21.6 | 22.7 | 0.11 |
| 36 | 55 | 24.3 | 8.5 | 7 | 0.2 | 23 | 9.3 | 2.5 | 21.6 | 22.7 | 0.11 |
| 37 | 55 | 28.5 | 8.5 | 6 | 0.2 | 21 | 8.9 | 2.4 | 21.6 | 22.7 | 0.11 |
| 38 | 55 | 24.3 | 13.5 | 7 | 0.2 | 24 | 9.8 | 2.4 | 35.2 | 31.4 | 0.18 |
| 39 | 55 | 28.5 | 13.5 | 8 | 0.1 | 22 | 9.0 | 2.4 | 35.2 | 31.4 | 0.18 |
| 40 | 55 | 24.3 | 16.2 | 8 | 0.1 | 23 | 8.7 | 2.6 | 38.4 | 33.3 | 0.19 |
| 41 | 55 | 28.5 | 16.2 | 7 | 0.1 | 20 | 9.6 | 2.1 | 42.6 | 35.7 | 0.21 |

| | Hot-dip coating | | Production conditions | | | | | | | |
|---|---|---|---|---|---|---|---|---|---|---|
| | | | Molten | First | Average cooling rate (° C./sec) | | | | | |
| No. | Interfacial alloy layer thickness (μm) | Left side of formula (1) | bath temperature (° C.) | cooling temperature (° C.) | To first cooling temperature | From first cooling temperature to 380° C. | Evaluation Chemical conversion corrosion resistance Flat part | Edge part | Worked part | Remarks |
| 1 | 1.2 | −56.0 | 590 | 540 | 5 | 23 | Poor | Poor | Poor | Comparative example |
| 2 | 1.2 | −73.0 | 590 | 540 | 5 | 23 | Poor | Poor | Poor | Comparative example |
| 3 | 1.0 | 6.4 | 590 | 540 | 5 | 23 | Satisfactory | Satisfactory | Satisfactory | Example |
| 4 | 1.0 | 11.2 | 590 | 540 | 5 | 23 | Satisfactory | Satisfactory | Satisfactory | Example |
| 5 | 0.9 | 0.0 | 590 | 540 | 5 | 23 | Unsatisfactory | Poor | Poor | Comparative example |
| 6 | 0.9 | 0.0 | 590 | 540 | 5 | 23 | Poor | Poor | Unsatisfactory | Comparative example |
| 7 | 0.9 | 1.2 | 590 | 540 | 5 | 23 | Poor | Poor | Poor | Comparative example |
| 8 | 0.9 | 2.0 | 590 | 540 | 5 | 23 | Satisfactory | Satisfactory | Satisfactory | Example |
| 9 | 0.9 | 6.2 | 590 | 540 | 5 | 23 | Satisfactory | Satisfactory | Satisfactory | Example |
| 10 | 0.9 | 11.7 | 590 | 540 | 5 | 23 | Satisfactory | Satisfactory | Satisfactory | Example |
| 11 | 0.7 | 0.0 | 590 | 540 | 5 | 23 | Poor | Poor | Poor | Comparative example |
| 12 | 0.7 | 0.1 | 590 | 540 | 5 | 23 | Poor | Poor | Poor | Comparative example |
| 13 | 0.7 | 1.9 | 590 | 540 | 5 | 23 | Satisfactory | Satisfactory | Satisfactory | Example |
| 14 | 0.6 | 3.1 | 590 | 560 | 5 | 23 | Excellent | Satisfactory | Excellent | Example |
| 16 | 0.7 | 4.3 | 590 | 540 | 5 | 23 | Satisfactory | Satisfactory | Satisfactory | Example |
| 17 | 0.7 | 11.4 | 590 | 540 | 5 | 23 | Satisfactory | Satisfactory | Satisfactory | Example |
| 18 | 0.7 | 16.8 | 590 | 540 | 5 | 23 | Unsatisfactory | Unsatisfactory | Unsatisfactory | Comparative example |
| 19 | 0.6 | 1.8 | 590 | 560 | 5 | 25 | Excellent | Satisfactory | Excellent | Example |
| 21 | 0.7 | 2.2 | 590 | 540 | 16 | 16 | Unsatisfactory | Unsatisfactory | Unsatisfactory | Comparative example |
| 22 | 0.7 | 2.2 | 590 | 540 | 18 | 18 | Unsatisfactory | Unsatisfactory | Unsatisfactory | Comparative example |
| 23 | 0.7 | 2.2 | 590 | 540 | 5 | 23 | Satisfactoiy | Satisfactory | Satisfactory | Example |
| 24 | 0.7 | 2.2 | 590 | 540 | 5 | 38 | Excellent | Satisfactory | Excellent | Example |
| 25 | 0.6 | 2.2 | 590 | 560 | 5 | 38 | Excellent | Satisfactory | Excellent | Example |
| 27 | 0.7 | 4.2 | 590 | 540 | 5 | 23 | Excellent | Satisfactory | Excellent | Example |
| 28 | 0.7 | 7.8 | 590 | 540 | 5 | 23 | Satisfactory | Satisfactory | Satisfactory | Example |
| 29 | 0.7 | 11.4 | 590 | 540 | 5 | 23 | Unsatisfactory | Unsatisfactory | Unsatisfactory | Comparative example |
| 30 | 0.7 | 1.4 | 590 | 540 | 15 | 15 | Unsatisfactory | Poor | Poor | Comparative example |
| 31 | 0.7 | 2.0 | 590 | 540 | 5 | 23 | Satisfactory | Satisfactory | Satisfactory | Example |
| 32 | 0.7 | 3.7 | 590 | 540 | 5 | 23 | Satisfactory | Satisfactory | Satisfactory | Example |
| 33 | 0.7 | 4.6 | 590 | 540 | 5 | 23 | Satisfactory | Satisfactory | Satisfactory | Example |
| 34 | 0.7 | 5.4 | 590 | 540 | 5 | 23 | Unsatisfactory | Unsatisfactory | Unsatisfactory | Comparative example |
| 35 | 0.7 | 1.8 | 590 | 540 | 5 | 23 | Satisfactory | Satisfactory | Satisfactory | Example |
| 36 | 0.7 | 3.1 | 590 | 540 | 5 | 23 | Satisfactory | Satisfactory | Satisfactory | Example |
| 37 | 0.7 | 3.6 | 590 | 540 | 5 | 23 | Unsatisfactory | Unsatisfactory | Unsatisfactory | Comparative example |
| 38 | 0.7 | 1.9 | 590 | 540 | 5 | 23 | Satisfactory | Satisfactory | Satisfactory | Example |
| 39 | 0.7 | 2.2 | 590 | 540 | 5 | 23 | Unsatisfactory | Unsatisfactory | Unsatisfactory | Comparative example |
| 40 | 0.7 | 1.6 | 590 | 540 | 5 | 23 | Unsatisfactory | Poor | Poor | Comparative example |
| 41 | 0.7 | 1.8 | 590 | 540 | 5 | 23 | Unsatisfactory | Unsatisfactory | Unsatisfactory | Comparative example |

It can be seen from Table 2 that the samples of the "Examples" had excellent corrosion resistance in flat parts, edge parts, and worked parts compared to the samples of the "Comparative examples".

Example 3

With respect to each of the hot-dip Al—Zn—Mg—Si coated steel sheet samples subjected to formation of a chemical conversion coating in Example 2, 5 μm of an epoxy resin-based primer (JT-25 produced by Nippon Fine Coatings) and 15 μm of a melamine cured polyester-based top coating (NT-GLT produced by Nippon Fine Coatings) were applied in this order and dried to produce a coated steel sheet sample.

Production conditions (molten bath temperature, first cooling temperature, and cooling rate) and hot-dip coating conditions (composition, major diameter of $Mg_2Si$, minor diameter/major diameter of $Mg_2Si$, thickness of hot-dip coating, left side of formula (1), left side of formula (2), $Mg_2Si$ content in main layer, $Mg_2Si$ area ratio in main layer cross-section, intensity ratio of $Mg_2Si$ relative to Al, and thickness of interfacial alloy layer) are shown in Table 3.

(Evaluation of Post-Coating Corrosion Resistance)

(1) Evaluation of Bent Worked Part Corrosion Resistance

Each coated steel sheet sample was worked by 180° bending to sandwich three sheets of the same sheet thickness at the inside (3T bending), and was then subjected to a Japan Automotive Standards Organization Cyclic Corrosion Test (JASO-CCT) at the outside of the bend. Each cycle of the JASO-CCT included salt spraying, drying, and wetting under specific conditions as illustrated in FIG. 6.

The number of cycles until red rust formed was counted with respect to the worked part of each of the samples, and was then evaluated in accordance with the following standard.

Excellent: Red rust formation cycle count≥600 Cycles

Satisfactory: 400 Cycles≤Red rust formation cycle count<600 Cycles

Unsatisfactory: 300 Cycles≤Red rust formation cycle count<400 Cycles

Poor: Red rust formation cycle count<300 Cycles

TABLE 3

| | Hot-dip coating | | | | | | | | | | | | | Production conditions | | | | Evaluation | |
|---|---|---|---|---|---|---|---|---|---|---|---|---|---|---|---|---|---|---|---|
| | Composition (mass %) | | | | | | | | | | | | | | | Average cooling rate (° C./sec) | | | |
| No. | Al | Mg | Si | $Mg_2Si$ major diameter (μm) | $Mg_2Si$ minor diameter/major diameter | Coating thickness (μm) | Dendrite diameter (μm) | Left side of formula (2) | $Mg_2Si$ content (mass %) | $Mg_2Si$ area ratio (%) | $Mg_2Si$/Al intensity ratio | Interfacial alloy layer thickness (μm) | Left side of formula (1) | Molten bath temperature (° C.) | First cooling temperature (° C.) | To first cooling temperature | From first cooling temperature to 380° C. | Post-coating corrosion resistance Worked part | Remarks |
| 1 | 55 | 5.6 | 0.5 | No $Mg_2Si$ | No $Mg_2Si$ | 21 | 10.5 | 2.0 | 0.0 | 0.0 | 0.00 | 1.2 | −56.0 | 590 | 540 | 5 | 23 | Poor | Comparative example |
| 2 | 55 | 7.3 | 0.5 | No $Mg_2Si$ | No $Mg_2Si$ | 22 | 12.2 | 1.8 | 0.0 | 0.0 | 0.00 | 1.2 | −73.0 | 590 | 540 | 5 | 23 | Poor | Comparative example |
| 3 | 55 | 3.2 | 1.1 | 8 | 0.2 | 23 | 11.6 | 2.0 | 1.4 | 1.2 | 0.01 | 1.0 | 6.4 | 590 | 540 | 5 | 23 | Satisfactory | Example |
| 4 | 55 | 5.6 | 1.1 | 6 | 0.1 | 26 | 10.9 | 2.4 | 1.4 | 1.2 | 0.01 | 1.0 | 11.2 | 590 | 540 | 5 | 23 | Satisfactory | Example |
| 5 | 55 | 0.0 | 1.5 | No $Mg_2Si$ | No $Mg_2Si$ | 24 | 11.4 | 2.1 | 0.0 | 0.0 | 0.00 | 0.9 | 0.0 | 590 | 540 | 5 | 23 | Poor | Comparative example |
| 6 | 55 | 0.0 | 1.5 | No $Mg_2Si$ | No $Mg_2Si$ | 23 | 10.8 | 2.1 | 0.0 | 0.0 | 0.00 | 0.9 | 0.0 | 590 | 540 | 5 | 23 | Unsatisfactory | Comparative example |
| 7 | 55 | 1.1 | 1.5 | 9 | 0.2 | 21 | 15.7 | 1.3 | 1.7 | 4.2 | 0.01 | 0.9 | 1.2 | 590 | 540 | 5 | 23 | Poor | Comparative example |
| 8 | 55 | 1.8 | 1.5 | 6 | 0.2 | 22 | 12.3 | 1.8 | 2.5 | 5.3 | 0.01 | 0.9 | 2.0 | 590 | 540 | 5 | 23 | Satisfactory | Example |
| 9 | 55 | 5.6 | 1.5 | 8 | 0.2 | 24 | 9.6 | 2.5 | 2.5 | 5.3 | 0.01 | 0.9 | 6.2 | 590 | 540 | 5 | 23 | Satisfactory | Example |
| 10 | 55 | 10.5 | 1.5 | 7 | 0.2 | 23 | 11.6 | 2.0 | 2.5 | 5.3 | 0.01 | 0.9 | 11.7 | 590 | 540 | 5 | 23 | Satisfactory | Example |
| 11 | 55 | 0.0 | 2.3 | No $Mg_2Si$ | No $Mg_2Si$ | 20 | 12.5 | 1.6 | 0.0 | 0.0 | 0.00 | 0.7 | 0.0 | 590 | 540 | 5 | 23 | Poor | Comparative example |
| 12 | 55 | 0.2 | 2.3 | No $Mg_2Si$ | No $Mg_2Si$ | 22 | 15.5 | 1.4 | 0.3 | 1.3 | 0.00 | 0.7 | 0.1 | 590 | 540 | 5 | 23 | Poor | Comparative example |
| 13 | 55 | 3.2 | 2.3 | 6 | 0.2 | 25 | 10.4 | 2.4 | 4.6 | 8.1 | 0.02 | 0.7 | 1.9 | 590 | 540 | 5 | 23 | Satisfactory | Example |
| 14 | 55 | 5.6 | 2.4 | 7 | 0.2 | 21 | 11.0 | 1.9 | 3.6 | 6.9 | 0.02 | 0.6 | 3.1 | 590 | 560 | 5 | 23 | Excellent | Example |
| 16 | 55 | 7.3 | 2.3 | 8 | 0.2 | 23 | 10.6 | 2.2 | 4.6 | 8.1 | 0.02 | 0.7 | 4.3 | 590 | 540 | 5 | 23 | Satisfactory | Example |
| 17 | 55 | 19.4 | 2.3 | 7 | 0.2 | 24 | 10.2 | 2.4 | 4.6 | 8.1 | 0.02 | 0.7 | 11.4 | 590 | 540 | 5 | 23 | Satisfactory | Example |
| 18 | 55 | 28.5 | 2.3 | 8 | 0.1 | 26 | 10.7 | 2.4 | 4.6 | 8.1 | 0.02 | 0.7 | 16.8 | 590 | 540 | 5 | 23 | Unsatisfactory | Comparative example |
| 19 | 55 | 4.5 | 3.1 | 9 | 0.2 | 24 | 9.9 | 2.4 | 5.1 | 8.5 | 0.02 | 0.6 | 1.8 | 590 | 560 | 5 | 25 | Excellent | Example |
| 21 | 55 | 5.6 | 3.1 | 8 | 0.3 | 24 | 19.4 | 1.2 | 6.8 | 10.5 | 0.03 | 0.7 | 2.2 | 590 | 540 | 16 | 16 | Unsatisfactory | Comparative example |
| 22 | 55 | 5.6 | 3.1 | 8 | 0.3 | 22 | 17.1 | 1.3 | 6.8 | 10.5 | 0.03 | 0.7 | 2.2 | 590 | 540 | 18 | 18 | Unsatisfactory | Comparative example |
| 23 | 55 | 5.6 | 3.1 | 7 | 0.2 | 21 | 13.2 | 1.6 | 6.8 | 10.5 | 0.03 | 0.7 | 2.2 | 590 | 540 | 5 | 23 | Satisfactory | Example |
| 24 | 55 | 5.6 | 3.1 | 8 | 0.2 | 22 | 10.8 | 2.0 | 6.8 | 10.5 | 0.03 | 0.7 | 2.2 | 590 | 540 | 5 | 38 | Satisfactory | Example |
| 25 | 55 | 5.6 | 3.1 | 8 | 0.2 | 22 | 10.8 | 2.0 | 5.9 | 9.5 | 0.03 | 0.6 | 2.2 | 590 | 560 | 5 | 38 | Excellent | Example |
| 27 | 55 | 10.5 | 3.1 | 8 | 0.2 | 22 | 10.5 | 2.1 | 6.8 | 10.5 | 0.03 | 0.7 | 4.2 | 590 | 540 | 5 | 23 | Satisfactory | Example |
| 28 | 55 | 19.4 | 3.1 | 9 | 0.2 | 23 | 9.6 | 2.4 | 6.8 | 10.5 | 0.03 | 0.7 | 7.8 | 590 | 540 | 5 | 23 | Satisfactory | Example |
| 29 | 55 | 28.5 | 3.1 | 8 | 0.1 | 21 | 9.2 | 2.3 | 6.8 | 10.5 | 0.03 | 0.7 | 11.4 | 590 | 540 | 5 | 23 | Unsatisfactory | Comparative example |
| 30 | 55 | 7.3 | 5.9 | 14 | 0.5 | 20 | 16.4 | 1.2 | 11.5 | 14.9 | 0.06 | 0.7 | 1.4 | 590 | 540 | 15 | 15 | Poor | Comparative example |

TABLE 3-continued

| | Hot-dip coating | | | | | | | | | | | | | Production conditions | | | | Evaluation | |
|---|---|---|---|---|---|---|---|---|---|---|---|---|---|---|---|---|---|---|---|
| | Composition (mass %) | | | | | | | | | | | | | | | Average cooling rate (° C./sec) | | | |
| No. | Al | Mg | Si | $Mg_2Si$ major diameter (μm) | $Mg_2Si$ minor diameter/major diameter | Coating thickness (μm) | Dendrite diameter (μm) | Left side of formula (2) | $Mg_2Si$ content (mass %) | $Mg_2Si$ area ratio (%) | $Mg_2Si$/Al intensity ratio | Interfacial alloy layer thickness (μm) | Left side of formula (1) | Molten bath temperature (° C.) | First cooling temperature (° C.) | To first cooling temperature | From first cooling temperature to 380° C. | Post-coating corrosion resistance Worked part | Remarks |
| 31 | 55 | 10.5 | 5.9 | 7 | 0.2 | 22 | 9.5 | 2.3 | 14.5 | 17.4 | 0.07 | 0.7 | 2.0 | 590 | 540 | 5 | 23 | Satisfactory | Example |
| 32 | 55 | 19.4 | 5.9 | 6 | 0.2 | 21 | 10.3 | 2.0 | 14.5 | 17.4 | 0.07 | 0.7 | 3.7 | 590 | 540 | 5 | 23 | Satisfactory | Example |
| 33 | 55 | 24.3 | 5.9 | 8 | 0.2 | 21 | 9.4 | 2.2 | 14.5 | 17.4 | 0.07 | 0.7 | 4.6 | 590 | 540 | 5 | 23 | Satisfactory | Example |
| 34 | 55 | 28.5 | 5.9 | 7 | 0.1 | 24 | 11.1 | 2.2 | 14.5 | 17.4 | 0.07 | 0.7 | 5.4 | 590 | 540 | 5 | 23 | Unsatisfactory | Comparative example |
| 35 | 55 | 14.2 | 8.5 | 7 | 0.2 | 22 | 9.7 | 2.3 | 21.6 | 22.7 | 0.11 | 0.7 | 1.8 | 590 | 540 | 5 | 23 | Satisfactory | Example |
| 36 | 55 | 24.3 | 8.5 | 7 | 0.2 | 23 | 9.3 | 2.5 | 21.6 | 22.7 | 0.11 | 0.7 | 3.1 | 590 | 540 | 5 | 23 | Satisfactory | Example |
| 37 | 55 | 28.5 | 8.5 | 6 | 0.2 | 21 | 8.9 | 2.4 | 21.6 | 22.7 | 0.11 | 0.7 | 3.6 | 590 | 540 | 5 | 23 | Unsatisfactory | Comparative example |
| 38 | 55 | 24.3 | 13.5 | 7 | 0.2 | 24 | 9.8 | 2.4 | 35.2 | 31.4 | 0.18 | 0.7 | 1.9 | 590 | 540 | 5 | 23 | Satisfactory | Example |
| 39 | 55 | 28.5 | 13.5 | 8 | 0.1 | 22 | 9.0 | 2.4 | 35.2 | 31.4 | 0.18 | 0.7 | 2.2 | 590 | 540 | 5 | 23 | Unsatisfactory | Comparative example |
| 40 | 55 | 24.3 | 16.2 | 8 | 0.1 | 23 | 8.7 | 2.6 | 38.4 | 33.3 | 0.19 | 0.7 | 1.6 | 590 | 540 | 5 | 23 | Poor | Comparative example |
| 41 | 55 | 28.5 | 16.2 | 7 | 0.1 | 20 | 9.6 | 2.1 | 42.6 | 35.7 | 0.21 | 0.7 | 1.8 | 590 | 540 | 5 | 23 | Unsatisfactory | Comparative example |

It can be seen from Table 3 that the samples of the "Examples" had excellent corrosion resistance in worked parts compared to the samples of the "Comparative examples".

Example 4

Some of the hot-dip Al—Zn—Mg—Si coated steel sheet samples produced in Example 1 (refer to Table 4 for the sample numbers) were each sheared to a size of 90 mm×70 mm and then subjected to zinc phosphate treatment as chemical conversion treatment, followed by electrodeposition coating, intermediate coating, and top coating in the same way as in coating treatment for an automobile outer panel.

Zinc phosphate treatment: A degreasing agent "FC-E2001" produced by Nihon Parkerizing Co., Ltd., a surface-modifying agent "PL-X" produced by Nihon Parkerizing Co., Ltd., and a zinc phosphate treatment agent "PB-AX35M" (temperature: 35° C.) produced by Nihon Parkerizing Co., Ltd. were used under conditions of a free-fluorine concentration in the zinc phosphate treatment liquid of 200 ppm and an immersion time in the zinc phosphate treatment liquid of 120 seconds.

Electrodeposition coating: An electrodeposition coating material "GT-100" produced by Kansai Paint Co., Ltd. was used to perform electrodeposition coating with a thickness of 15 μm.

Intermediate coating: An intermediate coating material "TP-65-P" produced by Kansai Paint Co., Ltd. was used to perform spray coating with a thickness of 30 μm.

Top coating: A top coating material "Neo6000" produced by Kansai Paint Co., Ltd. was used to perform spray coating with a thickness of 30 μm.

Production conditions (molten bath temperature, first cooling temperature, and cooling rate) and hot-dip coating conditions (composition, major diameter of $Mg_2Si$, minor diameter/major diameter of $Mg_2Si$, thickness of hot-dip coating, left side of formula (1), left side of formula (2), $Mg_2Si$ content in main layer, $Mg_2Si$ area ratio in main layer cross-section, intensity ratio of $Mg_2Si$ relative to Al, and thickness of interfacial alloy layer) are shown in Table 4.

(Evaluation of Post-Coating Corrosion Resistance)

Figure 7:
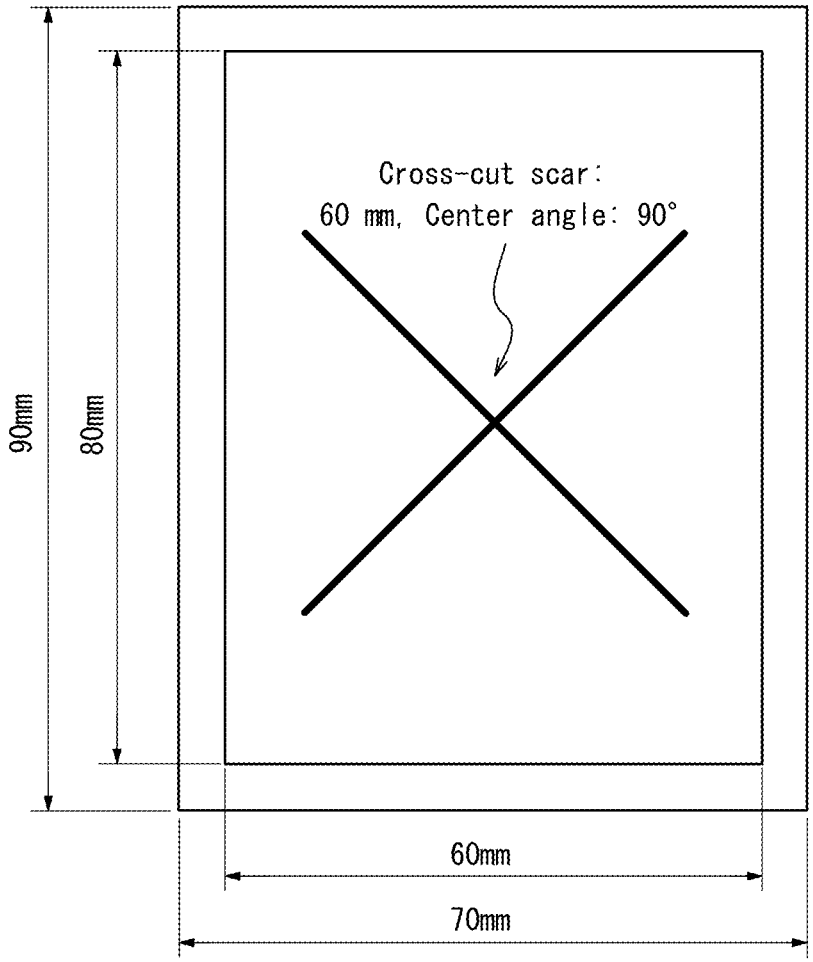
FIG. 7 illustrates a sample for evaluation of post-coating corrosion resistance.

For each of the hot-dip Al—Zn—Mg—Si coated steel sheet samples subjected to the coating treatment, a sample for evaluating post-coating corrosion resistance was obtained as illustrated in FIG. 7 by using tape to seal a non-evaluation surface (rear surface) and a 5 mm edge part of an evaluation surface, and then using a cutter knife to form a cross-cut scar in the center of the evaluation surface with a length of 60 mm and a center angle of 90°, and to a depth reaching the steel substrate of the hot-dip coated steel sheet.

Figure 8:
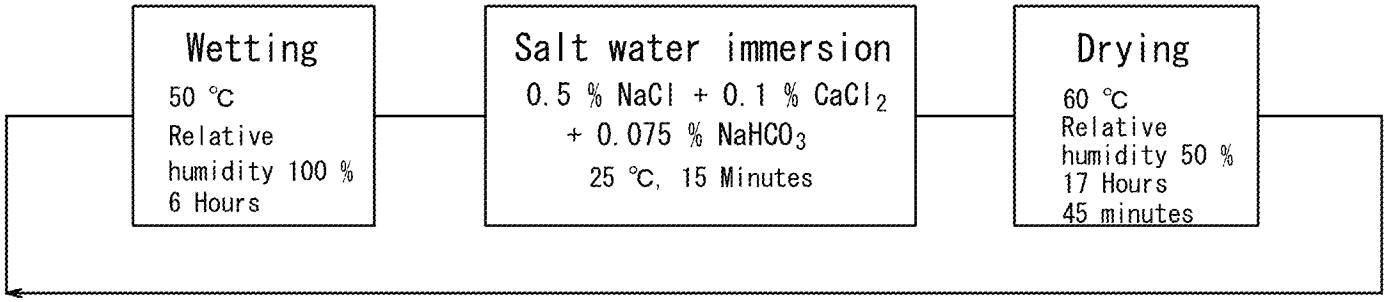
FIG. 8 illustrates a cycle of an accelerated corrosion test (SAE J 2334).

The evaluation sample was subjected to an accelerated corrosion test (SAE J 2334) through cycles illustrated in FIG. 8. The accelerated corrosion test was started from wetting and was continued until 30 cycles had been completed. The coating film blister width of a part at which greatest coating film blistering from the scar part occurred (maximum coating film blister width) was measured, and then post-coating corrosion resistance was evaluated in accordance with the following standard. The evaluation results are shown in Table 4.

Excellent: Maximum coating film blister width≤2.5 mm

Good: 2.5 mm<Maximum coating film blister width≤3.0 mm

Poor: 3.0 mm<Maximum coating film blister width

TABLE 4

| | Hot-dip coating | | | | | | | | | |
|---|---|---|---|---|---|---|---|---|---|---|
| | Composition (mass %) | | | $Mg_2Si$ major diameter | $Mg_2Si$ minor diameter/major diameter | Coating thickness | Dendrite diameter | Left side of formula | $Mg_2Si$ content | $Mg_2Si$ area ratio |
| No. | Al | Mg | Si | (μm) | | (μm) | (μm) | (2) | (mass %) | (%) |
| 62 | 55 | 3.2 | 1.5 | 7 | 0.1 | 17 | 10.9 | 1.6 | 2.4 | 5.2 |
| 63 | 55 | 5.6 | 1.5 | 8 | 0.2 | 15 | 9.6 | 1.6 | 2.6 | 5.5 |
| 64 | 55 | 7.3 | 1.5 | 6 | 0.2 | 16 | 10.1 | 1.6 | 2.5 | 5.3 |
| 65 | 55 | 10.5 | 1.5 | 7 | 0.2 | 17 | 10.8 | 1.6 | 2.6 | 5.5 |
| 66 | 55 | 14.2 | 1.5 | 7 | 0.2 | 17 | 10.7 | 1.6 | 2.5 | 5.3 |
| 68 | 55 | 7.3 | 3.1 | 8 | 0.2 | 15 | 9.1 | 1.6 | 6.8 | 10.5 |
| 69 | 30 | 4.8 | 2.9 | 6 | 0.2 | 17 | 10.5 | 1.6 | 6.4 | 10.1 |
| 70 | 35 | 4.8 | 2.9 | 7 | 0.2 | 17 | 10.8 | 1.6 | 6.2 | 9.9 |
| 71 | 45 | 4.8 | 2.9 | 8 | 0.3 | 16 | 10.3 | 1.6 | 6.3 | 10.0 |
| 72 | 65 | 4.8 | 2.9 | 8 | 0.2 | 18 | 11.2 | 1.6 | 6.3 | 10.0 |
| 73 | 70 | 4.8 | 2.9 | 8 | 0.2 | 18 | 11.5 | 1.6 | 6.1 | 9.8 |
| 74 | 55 | 0.0 | 1.5 | No $Mg_2Si$ | No $Mg_2Si$ | 15 | 15.0 | 1.0 | 0.0 | 0.0 |

| | Hot-dip coating | | | Production conditions | | | | Evaluation | |
|---|---|---|---|---|---|---|---|---|---|
| | | | | | | Average cooling rate (° C./sec) | | Post-coating corrosion resistance | |
| No. | $Mg_2Si$/Al intensity ratio | Interfacial alloy layer thickness (μm) | Left side of formula (1) | Molten bath temperature (° C.) | First cooling temperature (° C.) | To first cooling temperature | From first cooling temperature to 380° C. | Evaluation of coating film blister width | Remarks |
| 62 | 0.01 | 0.9 | 3.6 | 590 | 540 | 5 | 23 | Good | Example |
| 63 | 0.01 | 0.9 | 6.2 | 590 | 540 | 5 | 23 | Excellent | Example |
| 64 | 0.01 | 0.8 | 8.1 | 590 | 540 | 5 | 23 | Excellent | Example |
| 65 | 0.01 | 0.9 | 11.7 | 590 | 540 | 5 | 23 | Excellent | Example |

TABLE 4-continued

| | | | | | | | | | |
|---|---|---|---|---|---|---|---|---|---|
| 66 | 0.01 | 0.9 | 15.8 | 590 | 540 | 5 | 23 | Good | Example |
| 68 | 0.03 | 0.7 | 2.9 | 590 | 540 | 5 | 23 | Excellent | Example |
| 69 | 0.03 | 0.5 | 2.1 | 560 | 520 | 5 | 23 | Good | Example |
| 70 | 0.03 | 0.5 | 2.1 | 570 | 530 | 5 | 23 | Good | Example |
| 71 | 0.03 | 0.7 | 2.1 | 590 | 540 | 5 | 23 | Good | Example |
| 72 | 0.03 | 0.7 | 2.1 | 590 | 540 | 5 | 23 | Good | Example |
| 73 | 0.03 | 0.9 | 2.1 | 620 | 570 | 5 | 23 | Good | Example |
| 74 | 0.00 | 1.2 | 0.0 | 590 | 540 | 5 | 23 | Poor | Comparative example |

It can be seen from Table 4 that in the case of samples for which the Mg content was greater than 5 mass %, in contrast to samples for which the Mg content was 5 mass % or less, the maximum coating film blister width was restricted to 2.5 mm or less, and hot-dip Al—Zn alloy coated steel sheets having excellent post-coating corrosion resistance were obtained.

Accordingly, it can be seen that among the samples of the "Examples", a hot-dip Al—Zn—Mg—Si coated steel sheet having excellent post-coating corrosion resistance can be obtained by controlling the Mg content in the hot-dip coating layer to within an appropriate range.

INDUSTRIAL APPLICABILITY

According to this disclosure, it is possible to provide a hot-dip Al—Zn—Mg—Si coated steel sheet having good corrosion resistance in flat parts and edge parts, and also having excellent worked part corrosion resistance, and also to provide a method of producing this hot-dip Al—Zn—Mg—Si coated steel sheet.

The invention claimed is:

1. A hot-dip Al—Zn—Mg—Si coated steel sheet comprising a base steel sheet and a hot-dip coating on a surface of the base steel sheet, wherein the hot-dip coating includes an interfacial alloy layer present at an interface with the base steel sheet and a main layer present on the interfacial alloy layer, and consists of from 25 mass % to 80 mass % of Al, from greater than 0.6 mass % to 15 mass % of Si, from greater than 0.1 mass % to 25 mass % of Mg, optionally from 0.2 mass % to 25 mass % of Ca, optionally one or more selected from Mn, V, Mo, Ti, Sr, Ni, Co, Sb, and B in a total amount of from 0.01 mass % to 10 mass %, and the balance being Zn and incidental impurities, and Mg content and Si content in the hot-dip coating satisfy formula (1):

$$M_{Mg}/(M_{Si}-0.6)>1.7 \quad (1)$$

where $M_{Mg}$ represents the Mg content in mass % and $M_{Si}$ represents the Si content in mass %, and wherein the main layer includes an α-Al phase dendritic region, and a mean dendrite diameter of the α-Al phase dendritic region and a thickness of the hot-dip coating satisfy formula (2):

$$t/d\geq 1.5 \quad (2)$$

where t represents the thickness of the hot-dip coating in μm and d represents the mean dendrite diameter in μm.

2. The hot-dip Al—Zn—Mg—Si coated steel sheet according to claim 1, wherein the main layer contains $Mg_2Si$, and $Mg_2Si$ content in the main layer is 1.0 mass % or more.

3. The hot-dip Al—Zn—Mg—Si coated steel sheet according to claim 2, wherein the content of Al in the hot-dip coating is from 25 mass % to 80 mass %, the content of Si in the hot-dip coating is from greater than 2.3 mass % to 5 mass %, and the content of Mg in the hot-dip coating is from 3 mass % to 10 mass %.

4. The hot-dip Al—Zn—Mg—Si coated steel sheet according to claim 2, wherein the content of Al in the hot-dip coating is from 25 mass % to 80 mass %, the content of Si in the hot-dip coating is from greater than 0.6 mass % to 15 mass %, and the content of Mg in the hot-dip coating is from greater than 5 mass % to 10 mass %.

5. The hot-dip Al—Zn—Mg—Si coated steel sheet according to claim 1, wherein the main layer contains $Mg_2Si$, and an area ratio of $Mg_2Si$ in a cross-section of the main layer is 1% or more.

6. The hot-dip Al—Zn—Mg—Si coated steel sheet according to claim 5, wherein the content of Al in the hot-dip coating is from 25 mass % to 80 mass %, the content of Si in the hot-dip coating is from greater than 2.3 mass % to 5 mass %, and the content of Mg in the hot-dip coating is from 3 mass % to 10 mass %.

7. The hot-dip Al—Zn—Mg—Si coated steel sheet according to claim 5, wherein the content of Al in the hot-dip coating is from 25 mass % to 80 mass %, the content of Si in the hot-dip coating is from greater than 0.6 mass % to 15 mass %, and the content of Mg in the hot-dip coating is from greater than 5 mass % to 10 mass %.

8. The hot-dip Al—Zn—Mg—Si coated steel sheet according to claim 1, wherein the main layer contains $Mg_2Si$, and according to X-ray diffraction analysis, an intensity ratio of $Mg_2Si$ (111) planes having an interplanar spacing d of 0.367 nm relative to Al (200) planes having an interplanar spacing d of 0.202 nm is 0.01 or more.

9. The hot-dip Al—Zn—Mg—Si coated steel sheet according to claim 8, wherein the content of Al in the hot-dip coating is from 25 mass % to 80 mass %, the content of Si in the hot-dip coating is from greater than 2.3 mass % to 5 mass %, and the content of Mg in the hot-dip coating is from 3 mass % to 10 mass %.

10. The hot-dip Al—Zn—Mg—Si coated steel sheet according to claim 8, wherein the content of Al in the hot-dip coating is from 25 mass % to 80 mass %, the content of Si in the hot-dip coating is from greater than 0.6 mass % to 15 mass %, and the content of Mg in the hot-dip coating is from greater than 5 mass % to 10 mass %.

11. The hot-dip Al—Zn—Mg—Si coated steel sheet according to claim 1, wherein the interfacial alloy layer has a thickness of 1 μm or less.

12. The hot-dip Al—Zn—Mg—Si coated steel sheet according to claim 11, wherein the content of Al in the hot-dip coating is from 25 mass % to 80 mass %, the content of Si in the hot-dip coating is from greater than 2.3 mass % to 5 mass %, and the content of Mg in the hot-dip coating is from 3 mass % to 10 mass %.

13. The hot-dip Al—Zn—Mg—Si coated steel sheet according to claim 11, wherein the content of Al in the hot-dip coating is from 25 mass % to 80 mass %, the content of Si in the hot-dip coating is from greater than 0.6 mass % to 15 mass %, and the content of Mg in the hot-dip coating is from greater than 5 mass % to 10 mass %.

14. The hot-dip Al—Zn—Mg—Si coated steel sheet according to claim 1, wherein the content of Al in the hot-dip coating is from 25 mass % to 80 mass %, the content of Si in the hot-dip coating is from greater than 2.3 mass % to 5 mass %, and the content of Mg in the hot-dip coating is from 3 mass % to 10 mass %.

15. The hot-dip Al—Zn—Mg—Si coated steel sheet according to claim 1, wherein the content of Al in the hot-dip coating is from 25 mass % to 80 mass %, the content of Si in the hot-dip coating is from greater than 0.6 mass % to 15 mass %, and the content of Mg in the hot-dip coating is from greater than 5 mass % to 10 mass %.

16. The hot-dip Al—Zn—Mg—Si coated steel sheet according to claim 1, wherein the hot-dip coating has a thickness of 27 μm or less.

17. A method of producing the hot-dip Al—Zn—Mg—Si coated steel sheet of claim 1, comprising hot-dip coating a base steel sheet by immersing the base steel sheet in a molten bath consisting of from 25 mass % to 80 mass % of Al, from greater than 0.6 mass % to 15 mass % of Si, and from greater than 0.1 mass % to 25 mass % of Mg, optionally from 0.2 mass % to 25 mass % of Ca, optionally one or more selected from Mn, V, Mo, Ti, Sr, Ni, Co, Sb, and B in a total amount of from 0.01 mass % to 10 mass %, the balance being Zn and incidental impurities, subsequently cooling a resultant hot-dip coated steel sheet to a first cooling temperature at an average cooling rate of less than 10° C./sec, the first cooling temperature being no higher than a bath temperature of the molten bath and no lower than 50° C. below the bath temperature, and then cooling the hot-dip coated steel sheet from the first cooling temperature to 380° C. at an average cooling rate of 10° C./sec or more.

* * * * *